US009472390B2

(12) United States Patent
Verenchikov et al.

(10) Patent No.: US 9,472,390 B2
(45) Date of Patent: Oct. 18, 2016

(54) TANDEM TIME-OF-FLIGHT MASS SPECTROMETRY WITH NON-UNIFORM SAMPLING

(71) Applicant: LECO Corporation, St. Joseph, MI (US)

(72) Inventors: Anatoly N. Verenchikov, St. Petersburg (RU); Vasily Makarov, St. Petersburg (RU)

(73) Assignee: LECO Corporation, St. Joseph, MI (US)

( * ) Notice: Subject to any disclaimer, the term of this patent is extended or adjusted under 35 U.S.C. 154(b) by 0 days.

(21) Appl. No.: 14/409,367

(22) PCT Filed: Jun. 18, 2013

(86) PCT No.: PCT/US2013/046279

§ 371 (c)(1),
(2) Date: Dec. 18, 2014

(87) PCT Pub. No.: WO2013/192161

PCT Pub. Date: Dec. 27, 2013

(65) Prior Publication Data

US 2015/0194296 A1 Jul. 9, 2015

Related U.S. Application Data

(60) Provisional application No. 61/661,268, filed on Jun. 18, 2012.

(51) Int. Cl.
*H01J 49/00* (2006.01)
*H01J 49/40* (2006.01)
*H01J 49/10* (2006.01)

(52) U.S. Cl.
CPC ..... *H01J 49/406* (2013.01); *H01J 49/005* (2013.01); *H01J 49/0027* (2013.01); *H01J 49/0031* (2013.01); *H01J 49/0081* (2013.01); *H01J 49/10* (2013.01)

(58) Field of Classification Search
CPC .... H01J 49/406; H01J 49/10; H01J 49/0031; H01J 49/005; H01J 49/0081; H01J 49/0027
USPC ..... 250/281, 282, 286, 287, 288
See application file for complete search history.

(56) References Cited

U.S. PATENT DOCUMENTS 5,202,563 A 4/1993 Cotter et al.
5,396,065 A * 3/1995 Myerholtz ..... H01J 49/40 250/282

(Continued)

FOREIGN PATENT DOCUMENTS

CN 1853255 A 10/2006
GB 1318400 A 5/1973

(Continued)

OTHER PUBLICATIONS

International Search Report dated Dec. 17, 2013, relating to International Application No. PCT/US2013/046279.

(Continued)

*Primary Examiner* — Michael Maskell
(74) *Attorney, Agent, or Firm* — Honigman Miller Schwartz and Cohn LLP

(57) ABSTRACT

A method and apparatus are disclosed for parallel all-mass tandem mass spectrometry employing multi-reflecting time-of-flight analyzer for both MS stages, preferably arranged within the same analyzer to secure ultra-high resolution. Sensitivity and speed of TOF-TOF tandem are enhanced by non-redundant multiplexing based on signal sparseness and on avoiding repetitive signal overlaps at multiple repetitions of true fragment signals. Non-redundant matrices of gate and delay timing are constructed by extending orthogonal Latin square matrices. The method is generalized for multiplexing of any multiple repetitive signal sources being sparse either spectrally, or spatially, or in time.

22 Claims, 15 Drawing Sheets

(56) References Cited

U.S. PATENT DOCUMENTS

| | | | | |
|---|---|---|---|---|
| 6,013,913 | A | 1/2000 | Hanson | |
| 6,160,256 | A | 12/2000 | Ishihara | |
| 6,198,096 | B1 * | 3/2001 | Le Cocq | H01J 49/0027 250/282 |
| 6,770,870 | B2 | 8/2004 | Vestal | |
| 7,196,324 | B2 | 3/2007 | Verentchikov | |
| 7,326,925 | B2 | 2/2008 | Verentchikov et al. | |
| 7,385,187 | B2 | 6/2008 | Verentchikov et al. | |
| 7,772,547 | B2 | 8/2010 | Verentchikov | |
| 2003/0001087 | A1 * | 1/2003 | Fuhrer | H01J 49/004 250/287 |
| 2005/0242279 | A1 | 11/2005 | Verentchikov | |
| 2007/0029473 | A1 * | 2/2007 | Verentchikov | H01J 49/406 250/281 |
| 2009/0250607 | A1 * | 10/2009 | Staats | G01N 30/466 250/282 |

FOREIGN PATENT DOCUMENTS

| | | | |
|---|---|---|---|
| GB | 2390935 | A | 1/2004 |
| GB | 2403063 | A | 12/2004 |
| GB | 2500743 | A | 10/2013 |
| WO | WO-2005001878 | A2 | 1/2005 |
| WO | WO-2010008386 | A1 | 1/2010 |
| WO | WO-2010138781 | A2 | 12/2010 |
| WO | WO-2011086430 | A1 | 7/2011 |
| WO | WO-2011135477 | A1 | 11/2011 |
| WO | WO-2013063587 | A2 | 5/2013 |

OTHER PUBLICATIONS

Chinese Office Action for the related application No. 201380039150.7 dated Jan. 28, 2016 with English translation thereof.

* cited by examiner

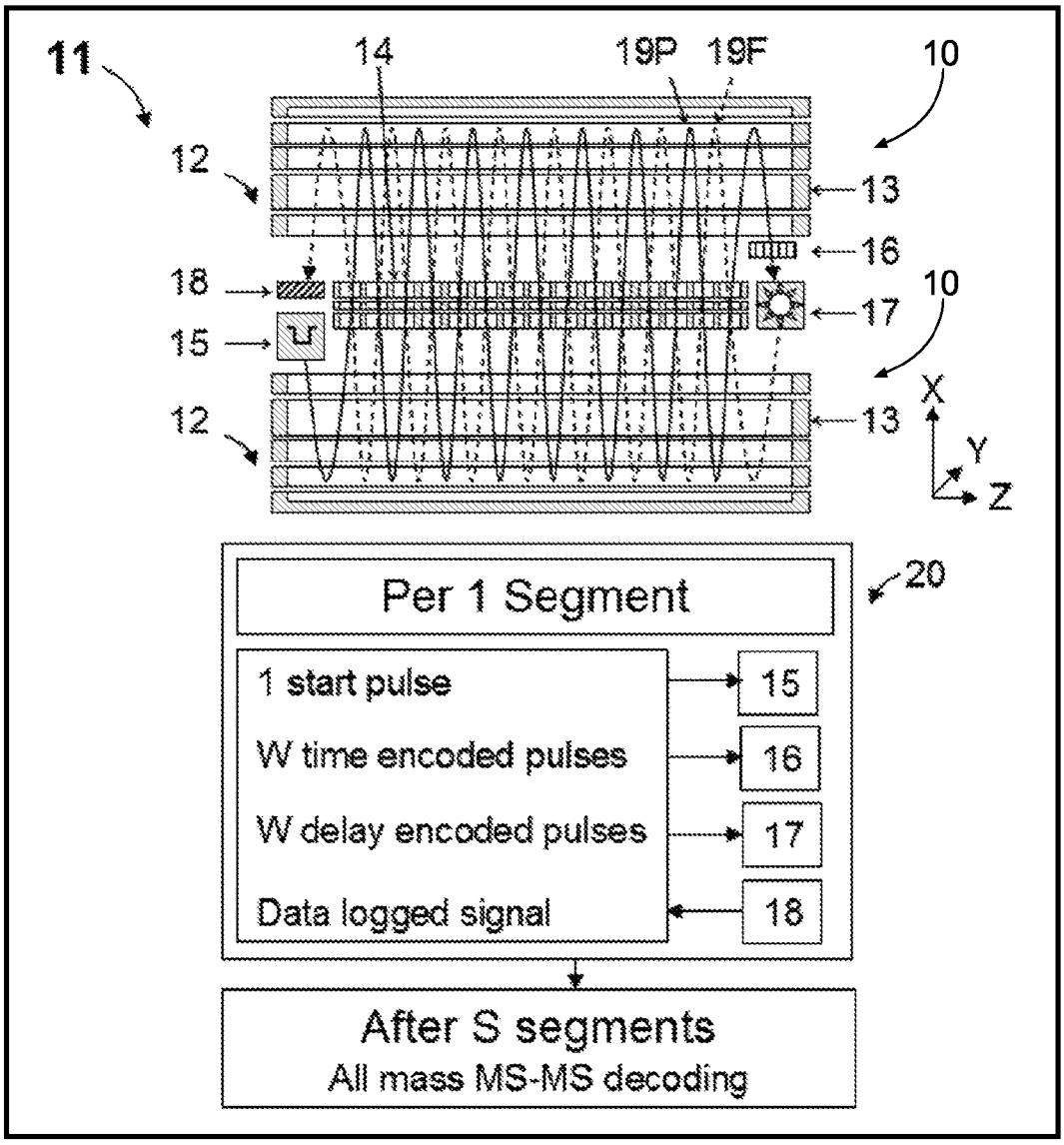
*Fig.1-A*

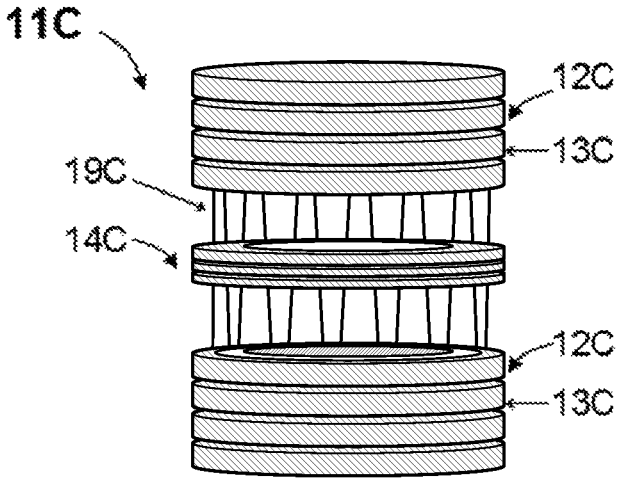
*Fig.1-B*

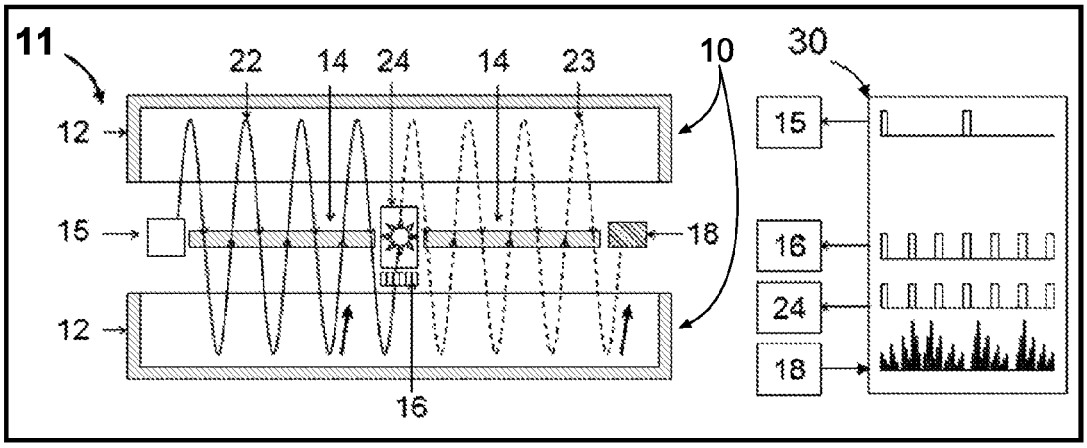
Fig.2-A
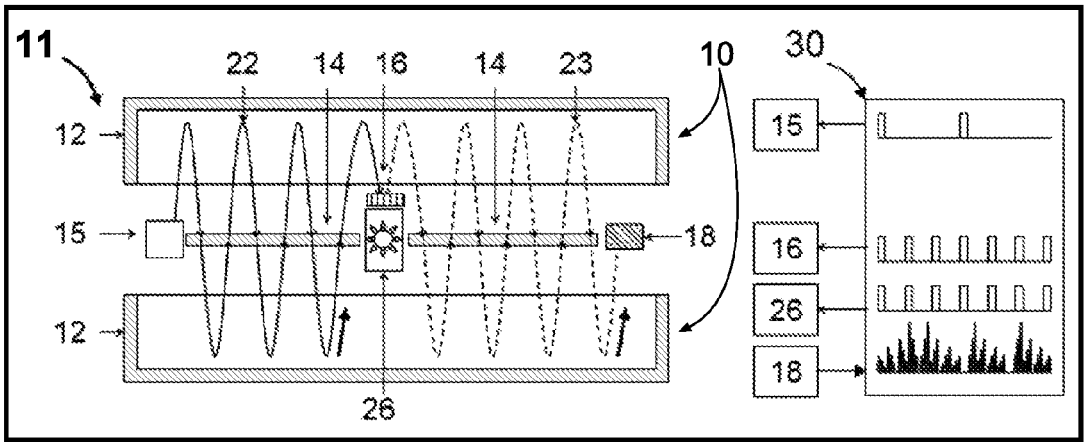
Fig.2-B
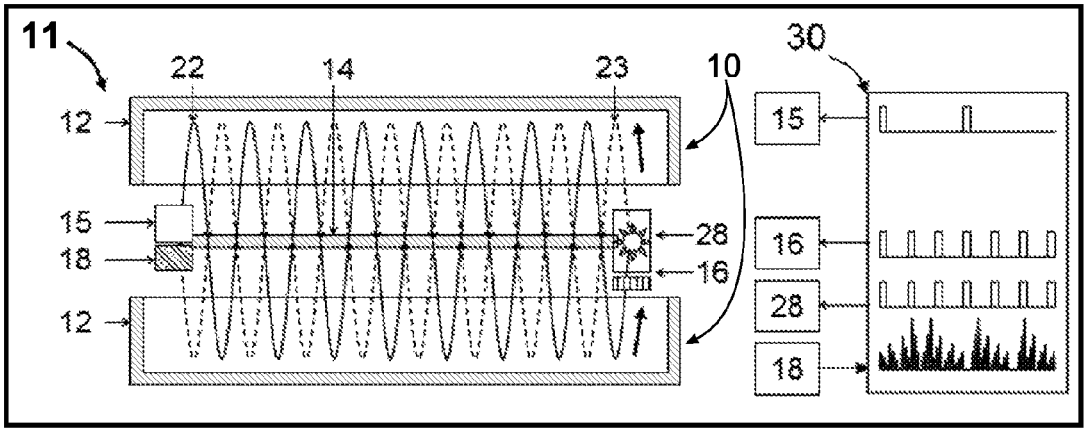
Fig.2-C

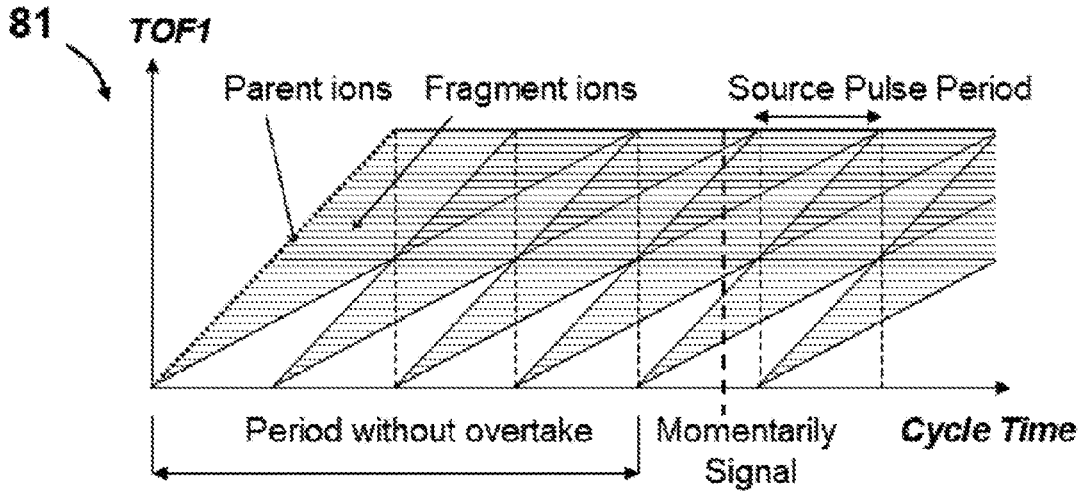
*Fig.8-A*
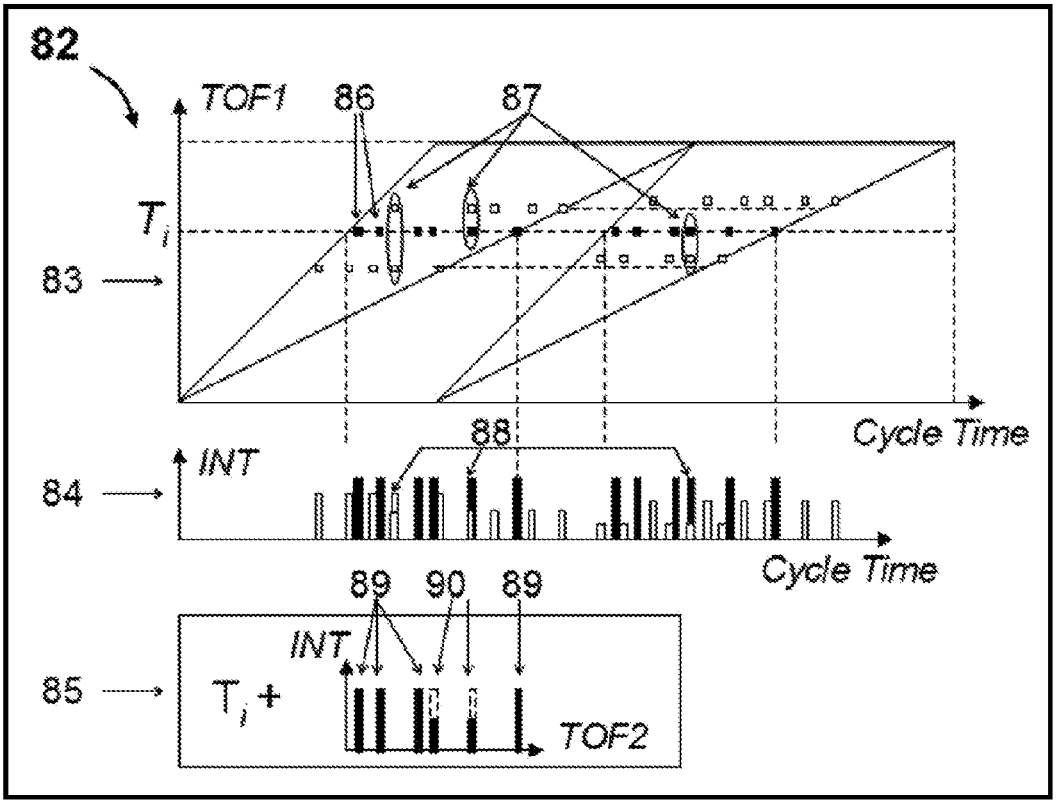
*Fig.8-B*

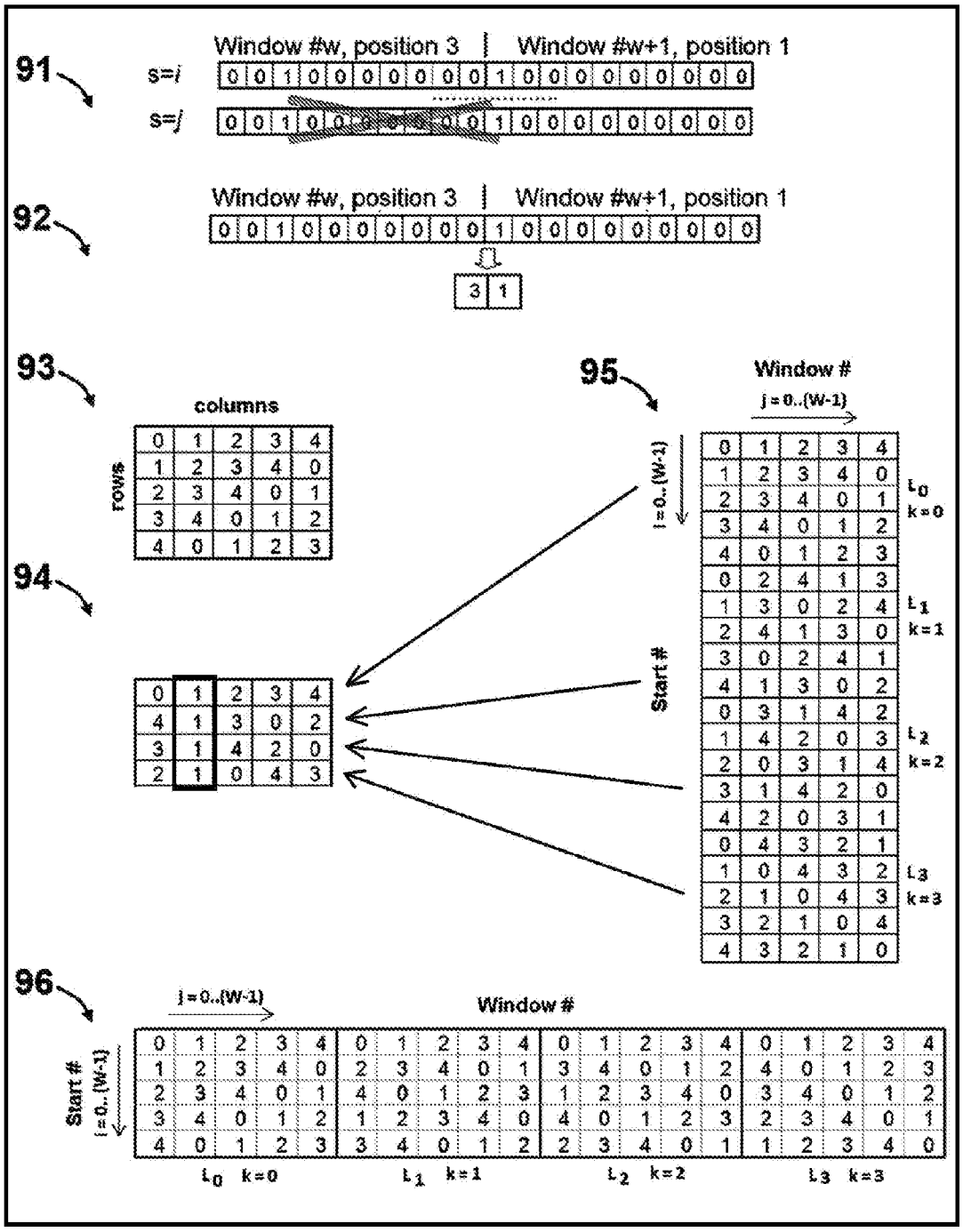
*Fig.9-A*

97 Encoding by gate positions

M

Window #

Start #

| | | | | | | |
|---|---|---|---|---|---|---|
| 0 | 1 | 2 | 3 | 4 | 5 | 6 |
| 1 | 2 | 3 | 4 | 5 | 6 | 0 |
| 2 | 3 | 4 | 5 | 6 | 0 | 1 |
| 3 | 4 | 5 | 6 | 0 | 1 | 2 |
| 4 | 5 | 6 | 0 | 1 | 2 | 3 |
| 5 | 6 | 0 | 1 | 2 | 3 | 4 |
| 6 | 0 | 1 | 2 | 3 | 4 | 5 |
| 0 | 2 | 4 | 6 | 1 | 3 | 5 |
| 1 | 3 | 5 | 0 | 2 | 4 | 6 |
| 2 | 4 | 6 | 1 | 3 | 5 | 0 |
| 3 | 5 | 0 | 2 | 4 | 6 | 1 |
| 4 | 6 | 1 | 3 | 5 | 0 | 2 |
| 5 | 0 | 2 | 4 | 6 | 1 | 3 |
| 6 | 1 | 3 | 5 | 0 | 2 | 4 |
| 0 | 3 | 6 | 2 | 5 | 1 | 4 |
| 1 | 4 | 0 | 3 | 6 | 2 | 5 |
| 2 | 5 | 1 | 4 | 0 | 3 | 6 |
| 3 | 6 | 2 | 5 | 1 | 4 | 0 |
| 4 | 0 | 3 | 6 | 2 | 5 | 1 |
| 5 | 1 | 4 | 0 | 3 | 6 | 2 |
| 6 | 2 | 5 | 1 | 4 | 0 | 3 |
| 0 | 4 | 1 | 5 | 2 | 6 | 3 |
| 1 | 5 | 2 | 6 | 3 | 0 | 4 |
| 2 | 6 | 3 | 0 | 4 | 1 | 5 |

...

98 Encoding by gate positions and delays gate delay

M*

Window #

Start #

| | | | | | | |
|---|---|---|---|---|---|---|
| 00 | 01 | 02 | 10 | 11 | 12 | 20 |
| 01 | 02 | 10 | 11 | 12 | 20 | 00 |
| 02 | 10 | 11 | 12 | 20 | 00 | 01 |
| 10 | 11 | 12 | 20 | 00 | 01 | 02 |
| 11 | 12 | 20 | 00 | 01 | 02 | 10 |
| 12 | 20 | 00 | 01 | 02 | 10 | 11 |
| 20 | 00 | 01 | 02 | 10 | 11 | 12 |
| 00 | 02 | 11 | 20 | 01 | 10 | 12 |
| 01 | 10 | 12 | 00 | 02 | 11 | 20 |
| 02 | 11 | 20 | 01 | 10 | 12 | 00 |
| 10 | 12 | 00 | 02 | 11 | 20 | 01 |
| 11 | 20 | 01 | 10 | 12 | 00 | 02 |
| 12 | 00 | 02 | 11 | 20 | 01 | 10 |
| 20 | 01 | 10 | 12 | 00 | 02 | 11 |
| 00 | 10 | 20 | 02 | 12 | 01 | 11 |
| 01 | 11 | 00 | 10 | 20 | 02 | 12 |
| 02 | 12 | 01 | 11 | 00 | 10 | 20 |
| 10 | 20 | 02 | 12 | 01 | 11 | 00 |
| 11 | 00 | 10 | 20 | 02 | 12 | 01 |
| 12 | 01 | 11 | 00 | 10 | 20 | 02 |
| 20 | 02 | 12 | 01 | 11 | 00 | 10 |
| 00 | 11 | 01 | 12 | 02 | 20 | 10 |
| 01 | 12 | 02 | 20 | 10 | 00 | 11 |
| 02 | 20 | 10 | 00 | 11 | 01 | 12 |

...

*Fig.9-B*

101
Multilexing with non-redundant sampling
| Encoding matrix | max. S | W | G | D | R | DC, % | P | S | N | k |
|---|---|---|---|---|---|---|---|---|---|---|
| 25x200 | 600 | 25 | 25 | 1 | 312 | 4 | 100 | 200 | 8 | 3...7 |
| 25x200 | 600 | 25 | 25 | 1 | 312 | 4 | 1000 | 200 | 8 | 3...6 |
102
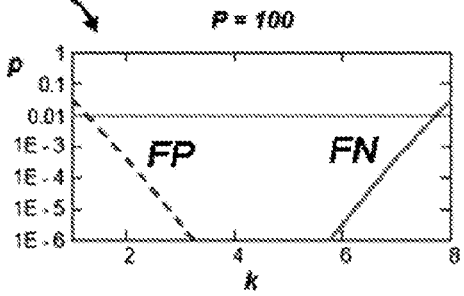
103
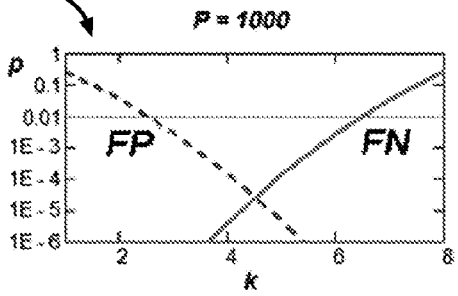
*Fig.10-A*
104
Multiplexing with delay encoding
| Encoding matrix | max. S | W | G | D | R | DC, % | P | S | N | k |
|---|---|---|---|---|---|---|---|---|---|---|
| 210x15 | 15 | 210 | 1 | 15 | 500 | 20 | 100 | 15 | 15 | 3...13 |
| 210x15 | 15 | 210 | 1 | 15 | 500 | 20 | 1000 | 15 | 15 | 8 |
105
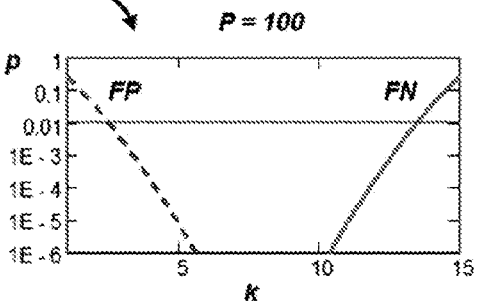
106
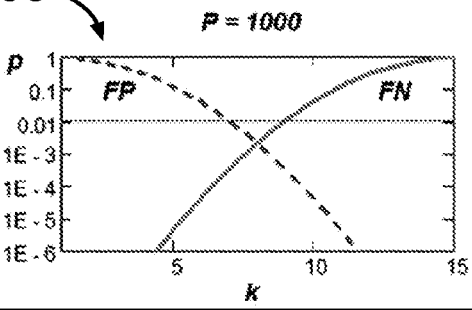
*Fig.10-B*

107
Combined multiplexing
| Encoding matrix | max. S | W | G | D | R | DC, % | P | S | N | k |
|---|---|---|---|---|---|---|---|---|---|---|
| 100x200 | 1E+4 | 100 | 17 | 6 | 850 | 6 | 100 | 200 | 12 | 7...11 |
| 100x200 | 1E+4 | 100 | 17 | 6 | 850 | 6 | 1000 | 200 | 12 | 7... 9 |
108
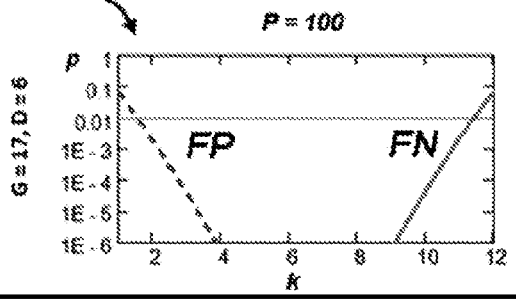
109
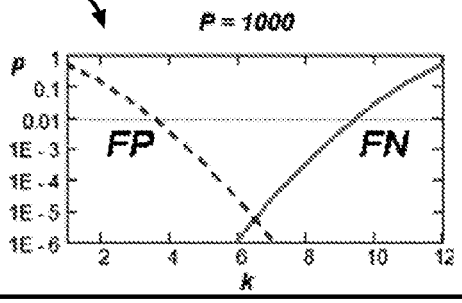
*Fig.10-C*
110
Combined multiplexing
| Encoding matrix | max. S | W | G | D | R | DC, % | P | S | N | k |
|---|---|---|---|---|---|---|---|---|---|---|
| 100x200 | 1E+4 | 100 | 6 | 17 | 300 | 17 | 100 | 200 | 34 | 18...31 |
| 100x200 | 1E+4 | 100 | 6 | 17 | 300 | 17 | 1000 | 200 | 34 | 18...23 |
111
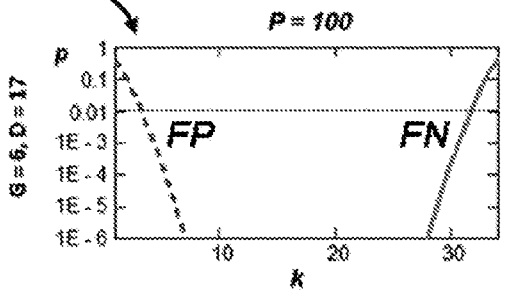
112
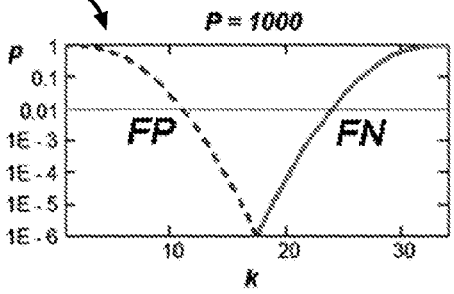
*Fig.10-D*

1100

| | | | Numerical Examples | | | | | | |
|---|---|---|---|---|---|---|---|---|---|
| **Settings** | Notation | units | No 1 | No 2 | No 3 | No 4 | No 5 | No 6 | No 7 |
| Parents' flight path | L1 | m | 10 | 20 | 10 | 40 | 40 | 40 | 80 |
| Fragments' flight path | L2 | m | 10 | 20 | 10 | 40 | 40 | 40 | 80 |
| Analyzer Type | Cyl/Planar | | PL | PL | PL | CYL | CYL | CYL | CYL |
| Acceleration Voltage | Uacc | kV | 8 | 2 | 8 | 2 | 8 | 8 | 8 |
| Flight Time for 1kDa | TOF1 | ms | 0.25 | 1 | 0.25 | 2 | 1 | 1 | 2 |
| Fragmentation Type | Cell Type | | CID | CID | SID | SID | SID | SID | SID |
| Cell Reference | Figure | | Fig.6 | Fig.6 | Fig.5 | Fig.4 | Fig.4 | Fig.4 | Fig.3 |
| Segemnts/Cycle | S | | 200 | 200 | 200 | 200 | 200 | 200 | 400 |
| Windows/segment | W | | 25 | 100 | 25 | 200 | 100 | 100 | 200 |
| Gates/window | G | | 25 | 17 | 25 | 1 | 6 | 17 | 20 |
| Gate comb Shifts | C | | 1 | 1 | 1 | 6 | 1 | 1 | 1 |
| Delays | D | | 1 | 6 | 1 | 17 | 17 | 6 | 10 |
| Fine gates/Crude gate | F | | 1 | 1 | 1 | 1 | 1 | 1 | 10 |
| **Encoding combination** | S, D, F | | **S** | **S+D** | **S** | **D** | **S+D** | **S+D** | **S+D+F** |
| Extraction pulse interval | Tpulse | us | 10 | 10 | 10 | 10 | 10 | 10 | 10 |
| **TOF-TOF Parameters** | | | | | | | | | |
| Duty Cycle | DC | % | 4% | 6% | 4% | 17% | 17% | 6% | 3% |
| Selection resolution | RS | | 300 | 850 | 300 | 600 | 300 | 850 | 20000 |
| Parent resolution | R1/1000 | | 100 | 100 | 100 | 200 | 400 | 400 | 800 |
| Fragment resolution | R2/1000 | | 100 | 100 | 100 | 200 | 400 | 400 | 800 |
| Cycle Time | Cycle Time | ms | 50 | 200 | 50 | 400 | 200 | 200 | 800 |
| Profiles time resolution | Profiles | ms | 6 | 17 | 6 | 12 | 6 | 17 | 40 |
| Multiplexing gain | Gain | | 25 | 100 | 25 | 33 | 100 | 100 | 200 |
| **Max Parent number** | P | | **1000** | **1000** | **1000** | **100** | **1000** | **1000** | **>1000** |

*Fig.11*

TANDEM TIME-OF-FLIGHT MASS SPECTROMETRY WITH NON-UNIFORM SAMPLING

CROSS REFERENCE TO RELATED APPLICATIONS

This international patent application claims priority to U.S. Provisional Application 61/661,268, filed on Jun. 18, 2012. The disclosures of this prior application are considered part of the disclosure of this application and are hereby incorporated by reference in its entireties.

TECHNICAL FIELD

The invention generally relates to the area of mass spectroscopic analysis, and more particularly to improving sensitivity, resolution, speed and/or dynamic range of tandem time-of-flight mass spectrometers.

BACKGROUND

Tandem mass spectrometry (MS-MS) employs separation of parent ions in a first mass spectrometer (MS1), fragmentation of separated species, and mass analysis of fragment ions in a second mass spectrometer (MS2) for compound identification and structural studies. The recent application of tandem mass spectrometry in life sciences brought the challenge of analyzing extremely complex mixtures, i.e., mixtures with up to millions of components with an ultimate requirement for nine orders of dynamic range. Such analyses may require an upfront chromatography for separating an original mixture into hundreds of fractions. Still, mixtures remain extremely complex, which stresses the requirements for sensitivity, dynamic range, resolution, mass accuracy, speed, and/or throughput of MS-MS.

Time-of-flight mass spectrometers (TOF MS) are widely used in analytical chemistry for identification and quantitative analysis of mixtures. TOF MS have a high potential for use in MS-MS because TOF MS offer intrinsically parallel analysis of all mass and recently achieved high resolving power. GB2403063 and WO2005001878 disclose a planar multi-reflecting TOF (MR-TOF) with a set of periodic lenses for spatial confinement of ion packets. An example commercial implementation of a MR-TOF, Citius IIR™ LECO Corp., demonstrates that the extended folded ion path improves resolution to R=100,000 level. Multiple improvements of MR-TOF are proposed in U.S. Pat. No. 7,326,925 (curved isochronous ion injection), U.S. Pat. No. 7,772,547 (double orthogonal injection), WO2010008386 (quasi-planar mirrors for drift focusing at reduced aberrations), WO2011086430 (cylindrical analyzers), and WO2013063587 (high-order isochronous ion mirrors). WO2011135477 discloses a frequent encoded pulsing of an orthogonal accelerator.

TOF MS have been employed for tandem time-of-flight mass spectrometers (TOF-TOF) when used with intrinsically pulsed ion sources, like MALDI. U.S. Pat. No. 5,202,563 discloses a tandem time-of-flight mass spectrometer (TOF-TOF) composed of two singly reflecting TOF MS coupled via a collisional ion dissociation (CID) cell. A timed ion selector (TIS) passes one parent ion mass per every TOF1 shot. Ions are decelerated in-front of a CID cell and then fragment ions are reaccelerated in a pulsed or continuous manner. U.S. Pat. No. 6,770,870 discloses a delayed fragment extraction for ion selection past CID cell. GB2390935, U.S. Pat. No. 7,385,187, and U.S. Pat. No. 7,196,324B disclose an "all-mass" TOF-TOF instrument for parallel acquisition of fragment spectra for all parent ions. The principle on nested time scales between TOF1 and TOF2 stages, however, does limit resolution of the second stage. US20070029473 and U.S. Pat. No. 7,385,187 disclose a tandem of two multi-reflecting TOF MS, coupled via a CID or SID cell, though operating sequentially, i.e., with selection of single parent specie per shot. WO2010138781 discloses a tandem of singly reflecting TOF analyzers while claiming selection of multiple parent ions per single ion source ejection, though not disclosing multiplexing algorithms.

Summarizing the above, the prior art TOF-TOF tandems do not yet reach parallel "all-mass" analysis while employing high resolution multi-reflecting TOF analyzers at both stages. Therefore, there is a need for improving resolution, sensitivity, speed, and dynamic range of TOF-TOF tandems. There is also a need for unambiguous encoding method for converting the proclaimed goal of all-mass parallel tandem analysis into practical method and instrument.

SUMMARY

According to some implementations of the present disclosure TOF-TOF may be improved by: (a) employing multi-reflecting TOF (MR-TOF) for both stages of tandem MS-MS analysis, thereby separating parent and fragment ions at comparable time scales and forming sparse signals in fragment spectra; (b) multiplexing parent ion samplings; and (c) encoding either gates for parent ion samplings, and/or delays of fragment ion extraction out of a fragmentation cell by a non-redundant matrix excluding systematic signal overlaps for a cycle of multiple source injection pulses. Spectra decoding may be achieved for all parent masses, with high duty cycle and resolution of MR-TOF, and with fast surface profiling or with fast profiling of the upfront chromatographic, mass spectrometric, or ion mobility separation.

According to some implementations, the process relies on the sparseness of high resolution tandem mass spectra. Typical fragment spectra are known to contain about 100 fragment peaks. Thus, single fragment spectrum occupies 0.1% of mass scale at 100,000 resolving power. Such signal sparseness allows non-redundant sampling (and/or delay encoding), which avoids systematic signal overlaps between hundreds of simultaneously acquired fragment spectra.

The process may also rely on not mixing signals between multiple starts. Though signal waveforms may be summed with long periods corresponding to encoding cycles, alternatively or additionally, the signal is recorded in a so-called "data logging" format where data are not summed between starts, but rather raw non-zero signals are passed to a processor along with the number of the current start. This preserves spectra sparseness, preserves information of spectral encoding, and allows rapid profiling of an upfront chromatographic, mass or mobility separation.

In some implementations, the process employs sole encoding of parent sampling gates or sole encoding of fragment extraction delays, or a combination of both in order to remain within a limited delay range while using higher duty cycle of parent sampling gates. In all cases, signals are decoded and collected into fragment spectra based on repetition of any particular fragment peak for any particular parent gate with the account of signal delays.

The process may be further enhanced by subsequent analysis of overlaps between identified fragment peaks, so as by analysis of intensity and centroid distributions within groups of repetitive fragment signals. In some implementations, the overlaps are discarded. In some implementations, the overlaps are deconvolved with the rest of group signals.

The multi-reflecting TOF (MR-TOF) analyzer may be employed for both stages of tandem MS-MS analysis, while passing parent and fragment ions through the same MR-TOF along different trajectories or along the same trajectory but at the reverted direction. An MR-TOF analyzer may be a planar MR-TOF or a cylindrical MR-TOF for providing even tighter trajectory folding and disclosed as disclosed in U.S. Pat. No. 7,196,324 and WO2011086430. Both analyzers are to employ periodic lens or spatial periodic modulation of ion mirror fields for better ion confinement in the drift direction. Preferably, such analyzers employ ion mirrors with high ($4^{th}$ or $5^{th}$) order time-per-energy focusing as described in co-pending application (WO2013063587). Higher energy isochronicity is particularly useful for handling larger energy spread of fragment ions.

Suitable pulsed ion sources can include axial RF trap, radial radio-frequency (RF) trap, or, an RF ion guide with radial ion ejection for coupling with continuous ion sources (ESI, APCI, APPI, and gaseous MALDI), or intrinsically pulsed sources such as ion accumulating EI source, pulsed SIMS, and DE MALDI ion source.

Multiple types of fragmentation cells may be employed by the comprehensive high resolving TOF-TOF, including: (a) a surface induced dissociation (SID) with a normally impinging parent ions and with a pulsed delayed extraction of fragment ions, (b) a pass-through high energy CID cell, and (c) an SID cell with gliding collisions with venetian blind surface followed by a pulsed delayed extraction. According to some implementations, the TOF-TOF may employ a pass-through low energy CID cell operated at mTorr gas pressure range and assisted by radiofrequency ion confinement.

Some implementations of the present disclosure provide comprehensive, i.e., all-mass, tandem MS-MS analysis for all parent ions with: (a) 3% to 30% duty cycle of parent ion sampling by time gate; (b) no losses at fragment ions extraction; (c) substantially accelerated (30-300 ms) speed of the tandem analysis; (d) high temporal resolution (10-30 ms); and (e) at high resolution of both mass spectrometric stages.

According to some implementations of the present disclosure, the TOF-TOF can be expected to form a representative data set within a cycle containing 30-300 start pulses, i.e., in 30-300 ms, accounting 1 ms flight time in MR-TOF. In case of MALDI source, such number of laser shots would not yet exhaust a single sample spot. The process is not only suitable for conventional chromatography LC, UPLS, and GC, but also feasible for relatively fast dual chromatographic separation, like GCxGC, LCxCE, and ion mobility separations. The process can be combined with a moderate speed of surface scanning and suits higher order tandems being combined with upfront mass separator for $MS^3$ analysis or to an IMS.

The proposed non-redundant multiplexing process of sparse signals may be employed for other tandems in mass spectrometry, other TOF-TOF, in spatially resolving mass-spectroscopy, as long as either spectral information or signal flux is sparse (e.g., rare ions).

According to some embodiments of the present disclosure, a method of tandem time-of-flight mass spectrometry analysis is disclosed. The method includes pulsed extracting a plurality of parent ion species of different m/z values out of an ion source or a pulsed converter and time separating the parent ions by m/z value within a multi-reflecting electrostatic field having isochronous and spatial focusing. The method also includes selecting a parent ion species by an electric pulsed field with a time gate delayed relative to the source pulse, fragmenting admitted parent ions in collisions with at least one of a gas and a surface, and extracting fragment ions by a pulsed electric field at a delay relative to the time gate. The method further includes time separating the fragment ions within the multi-reflecting electrostatic field and recording a signal waveform of the fragment ions by a detector. The selecting of the parent ion species is performed multiple times per single source pulse. Moreover, source pulses are repeated multiple times within a signal acquisition cycle. Additionally, at least one of gate times and extraction delays are encoded in a non-redundant manner that varies within a cycle of multiple source pulses. Furthermore, separate fragment spectra for the plurality of parent ion species are decoded based on a signal correlation with a repetitive occurrence of particular gate times with account of occurred extraction delay and with post analysis of occurred signal overlaps.

According to some aspects of the disclosure, both time separations of parent and fragment ions occur within the same multi-reflecting electrostatic field either along different mean trajectories or in opposite directions. The method may further include reconstructing chromatographic separation, surface scanning, or ion mobility profiles from intensity distributions of fragment ions corresponding to a same parent ion.

According to some implementations, the gate times and/or delay times are encoded by a non-redundant matrix constructed from a set of mutually orthogonal matrix blocks. According to some implementations, the extraction delays are chosen from a set of non-linearly progressing delays with minimal interval exceeding typical peak width in fragment spectra. In one method, the delay set is formed with linearly progressing intervals proportional to $n*(n+1)/2$ with an integer index n. The number of source pulses per the acquisition cycle may vary from 10 to above 1000, the number W of parent selection gates per single source pulse may vary from 10 to above 1000, and the average interval between parent selection pulses may vary from 10 ns to above 10 μs.

According to an aspect of the disclosure, a tandem time-of-flight mass spectrometer is disclosed. The mass spectrometer can include a pulsed ion source or pulsed converter that emits ion packet of plural parent species and a fragmentation cell with a pulsed acceleration of fragment ions. The mass spectrometer may further include a multi-reflecting time-of-flight mass (MR-TOF) analyzer arranged to pass parent and fragment ions within the same the MR-TOF analyzer either along different trajectories or in opposite directions. The mass spectrometer may further include a pulse generator configured to pulse at least two pulse strings triggering both timed selection of parent ions and delayed pulsed extraction of fragment ions and a data system configured to acquire non-mixed signals of fragment ions and to non-redundant encode the triggering pulses within a cycle of multiple source pulses. The non-redundant encoding is arranged to avoid or minimize repetitive overlapping of any two ion signals from different parent species at multiple repetitions of any individual gate time.

According to some implementations, the data system is arranged to acquire either one long signal waveform or a set of separate signal waveforms along with the information on the current start number. In some implementations, the apparatus may include a parallel processor configured to decode separate fragment spectra for all admitted parent ions based on a correlation between fragment signals and any particular gate time and with an optional reconstruction of occurred signal overlaps. Further, the pulsed source may be one of an axial or radial trap with radiofrequency ion confinement and pulsed ejection, a pass-through radiofrequency ion guide with pulsed radial ion ejection, a pulsed accumulating electron impact ion source, and a MALDI ion source with a delayed extraction.

Additionally or alternatively, the spectrometer may further include a deflector or a curved sector interface arranged that couples the MR-TOF analyzer to at least one of the pulsed ion source, the fragmentation cell, and a detector of the data system. According to some implementations, the MR-TOF analyzer is a planar or a cylindrical analyzer having at least a third order time-per-energy focusing and at least second order full focusing including cross aberration terms. In some implementations, the MR-TOF analyzer includes at least one of a set of periodic lenses within a field-free region and at least one spatially modulated electrode that spatial modulates an ion mirror field to confine ions along a zigzag trajectory in a drift direction. According to some implementations, the fragmentation cell is one of a surface induced dissociation (SID) with normally impinging parent ions and with a pulsed delayed extraction of fragment ions, a pass-through high energy collision induced dissociation (CID) cell, and an SID cell with gliding collisions followed by a pulsed delayed extraction.

According to another aspect of the disclosure, a set of operations for a method for performing multiplexed mass-spectral analysis is disclosed. The method includes sampling a subset of plural ion sources, forming a distinct, sparse and repetitive spectral signal with limited signal overlapping between sampled spectra from different ion sources, and recording a mass spectrum with at least one detector. The steps of sampling, forming, and spectral recording are repeated while varying the source subsets in a non-redundant fashion where combinations of any two simultaneously sampled sources are unique and any particular source is sampled multiple times. The method further includes decoding signals from all individual sources by correlating encoded signal with sources sampling.

According to some implementations of the disclosure, the encoding step is adjusted automatically based on a sparseness of the acquired spectra. Further, the method may include constructing a non-redundant matrix based on a set of mutually orthogonal square matrix blocks. Additionally or alternatively, the method may include delaying the ion sources with non-linearly progressing delays being encoded based on a non-redundant matrix. Further, the plurality of ion sources can be one of a subset of multiple ion flows multiplexed downstream of a single ion source and a subset of multiple ion packets generated in the single ion source or multiple pulsed ion sources or pulsed converters. In case of low complexity of parent spectra, the probability of spectra overlapping drops and the duty cycle of tandem analysis may be improved by using shorter non-redundant progressions which allow partial overlaps, so as m/z windows for parent selection may be widened.

The details of one or more implementations of the disclosure are set forth in the accompanying drawings and the description below. Other aspects, features, and advantages will be apparent from the description and drawings, and from the claims.

DESCRIPTION OF DRAWINGS

The details of one or more implementations of the disclosure are set forth in the accompanying drawings and the description below. Other aspects, features, and advantages will be apparent from the description and drawings, and from the claims.

FIG. 1-A is a schematic depicting an example multiplexed tandem multi-reflecting time-of-flight (MR-TOF) mass spectrometer employing single planar MR-TOF analyzer, and an encoding data system of the MR-TOF mass spectrometer.

FIG. 1-B is a schematic depicting a cylindrical geometry of tandem MR-TOF analyzer.

FIGS. 2-A-C are schematics depicting different arrangements of a fragmentation cell of a multiplexed tandem MR-TOF mass spectrometers.

FIGS. 8-A and B are schematics illustrating a relationship between a signal in laboratory time to parent ion time-of-flight and present example signals of parent and fragment ions to illustrate the principle of non-redundant multiplexing and of spectra decoding using correlation principle.

FIGS. 9-A and B are schematics illustrating an example of an orthogonal matrix and examples of non-redundant matrices for encoding times of parent sampling gates and/or extraction delays.

FIGS. 10-A-D are schematics illustrating tables of parameters of non-redundant matrices, so as graphs for probabilities of false negative and false positive identifications at overall number of parent ions P=100 and P=1000.

FIG. 11 is a schematic illustrating a table of estimated tandem MR-TOF parameters linked to non-redundant encoding parameters.

Like reference symbols in the various drawings indicate like elements.

DETAILED DESCRIPTION

Figure 3:
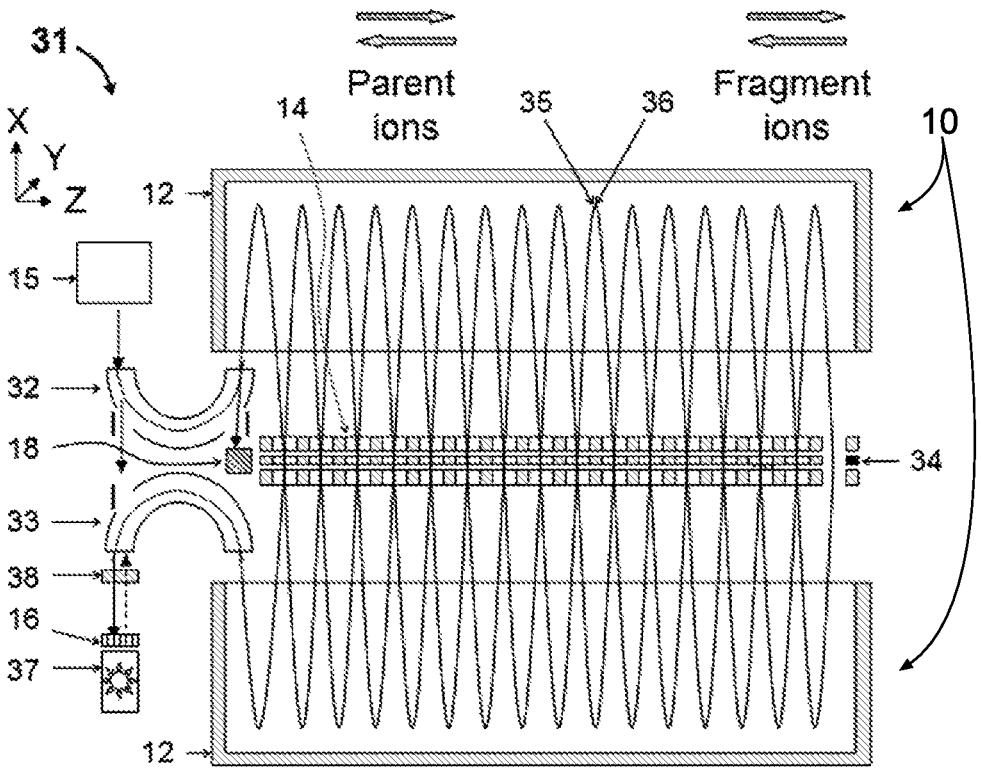
FIG. 3 is a schematic depicting a multiplexed tandem MR-TOF with an SID fragmentation cell coupled to MR-TOF analyzer via a curved isochronous inlet.

FIG. 1-A illustrates an example multiplexed tandem multi-reflecting time-of-flight (MR-TOF) mass spectrometer 11. According to some implementations, the MR-TOF mass spectrometer 11 includes a multi-reflecting time-of-flight (MR-TOF) analyzer having two parallel aligned ion mirrors 12 (here planar for purposes of explanation, though may be cylindrical), a drift space, and a periodic lens 14 in-between the mirrors 12. The MR-TOF mass spectrometer 11 further includes a pulsed ion source 15, a multiplexed time selector 16, a fragmentation cell 17, a detector 18, and a non-redundant multiplexing data system 20. Mean ion trajectories are shown as solid lines 19P for parent ions and as dashed lines 19F for fragment ions.

The pulsed ion source 15 may be, for example, (a) a radio-frequency (RF) ion trap with radial or axial ion ejection, either trapping ions or passing continuous ion flow at low ion energy; (b) an electron impact (EI) source; or (c) pulsed SIMS source; or (d) a MALDI source with a delayed extraction. According to some implementations, the energy spread of ion packets is substantially minimized under 10-20 eV by using lowered extraction fields in the pulsed ion source 15 and by minimizing ion cloud width in the direction of ion extraction. In the case of a radial trap, the foregoing corresponds to approximately 50-100 V/mm extraction field at 0.1-0.3 mm ion cloud width. A prolonged turn-around time, estimated about 10-20 ns for 1 kDa ions, can be compensated for by extending the ion flight path in the MR-TOF analyzer. At a 1 ms flight time, parent ions may be still resolved with 25-50,000 resolution. In some implementations, the ion mirrors 12 are gridless and provide high order time, i.e., second order or greater, spatial focusing with respect to energy, spatial, and angular spreads of ion packets, and at least third order time-per energy focusing, simultaneous with spatial ion focusing. In recent co-pending application (WO2013063587), ion mirrors with $5^{th}$ order time-per-energy focusing are disclosed. The ion mirrors 12 can include an electrode 13 with attracting potential for providing spatial ion focusing in the direction Y orthogonal to the drawing. A time selector 16 may include (a) a Bradbury-Nielsen bipolar wire gate; (b) a deflector; or (c) a set of miniature parallel deflectors. The fragmentation cell 17 can include (a) a surface induced dissociation (SID) cell where ions impinge onto a surface, preferably coated with perfluoropolymer, (b) a high-energy collisional dissociation (CID) cell, which may be surrounded by differential pumped stage, or (c) a venetian blind SID cell. In the foregoing embodiments, ions can be DC decelerated in-front of the cell 17 and DC reaccelerated past the cell. In addition to DC acceleration, a synchronized pulsed post-acceleration can be employed for time sharpening, i.e., bunching, of fragment packets and for adjusting their mean energy. The detector 18 can be a microchannel plate (MCP), a secondary multiplier (SEM), or a hybrid with intermediate scintillator. In some implementations, the detector 18 has an extended life time and dynamic range to handle ion fluxes of at least up to 1 E+8 ions/sec in order to match up to 10+10 ion/sec flux from ion sources at the expected 5-20% overall duty cycle of the tandem 11. In some implementations, the detector 18 includes a photo-multiplier (PMT) with life time of 100-300 Coulomb of the output current. The data system 20 provides time-encoded pulse strings to ion source 15 and time selector 16, as delayed (relative to selector 16) pulses to the fragmentation cell 17, and collects an ion signal from the detector 18. Non-redundant pulse encoding is described below. The data system 20 records non-zero strings of ion signals accompanied with a laboratory time stamp, e.g., the number of the current source pulse.

In operation, a cycle of start pulses triggers pulsed ejection of multiple parent ion species, different by ion mass (term 'mass' may be used as an abbreviation of mass-to-charge ratio). An interval between start pulses forms an experimental segment. Ions pass through the analyzer 10 along a folded jig-saw ion path 19P while being vertically focused by ion mirrors 12 and horizontally focused by periodic lens 14. MR-TOF analyzers 10 are configured to transfer ions with high order isochronicity and with spatial focusing. Ion packets of different masses become separated over time and as they approach the time gate 16. Within one segment, the time gate 16 samples (transfers) a plurality of parent masses at multiple gate times. Sampled ions are decelerated to less than 10% of initial energy, admitted to the fragmentation cell 17, and formed into fragment ions, either by collisions with gas and/or a surface. Fragment ions are accelerated by a delayed (relative to gate) pulse and then by a DC field. Pulsed acceleration serves for bunching and for energy adjustment. The strength of the pulsed accelerating field is chosen to keep fragment energy spread within 10-15%, permitting 100,000 resolution of MR-TOF with high-order focusing ion mirrors. Fragment ions pass through the same analyzer in the opposite drift direction (particular case) along the mean trajectory 19F and onto the detector 18. Sampling multiple parent species can cause overlapping between time spans of fragment ions and is likely to cause some overlapping of the fragment peaks. Spectra confusion can be avoided or minimized by implementing the non-redundant spectra encoding, wherein within a cycle of multiple source pulses, the spectral overlaps are not repeated. Using non-redundant spectra encoding, after a cycle of multiple starts, all parent species are admitted multiple times, repeated signals are taken, while random coinciding and non-repeating signals are discarded. Thus, fragment spectra are recovered for all of the parent species at much higher speeds and sensitivities compared to sequential (one per start) parent sampling.

The data system 20 provides a non-redundant encoding of multiple time gates and/or extraction delays such that any pair of exact gate times (i.e., any pair of parent masses) and/or extraction delays within one start segment can occur once (or very few times) at the duration of the entire cycle of multiple S segments, while any individual gate and/or extraction delays can occur multiple times. The data system 20 should acquire the detector signal from the detector 18 without mixing or summing for the duration of the entire cycle. The detector signal can be passed to a parallel multi-core processor. In continuous operation, the detector signal is analyzed within the sliding time frame corresponding to multiple segments, i.e., multiple starts. The correspondence between any particular signal peak and parent mass can be extracted based on the correlation therebetween, i.e., relevant true peaks can appear each time a particular parent mass admission (gate time), while any particular signal from other parent masses (gates) may occur once or very few times. At the completion of a cycle, post-analysis can be performed for all gates, thereby reconstructing time-of-flight fragment spectra for all the parent masses. Optionally, after reconstructing all fragment spectra, the expected signal overlapping may be accounted and deconvolved for higher and more accurate spectra recovery (experiment replay within the data analyzing program).

At the signal analysis stage, the data system 20 employs a core principle of sparse data. It is considered that high resolution analyzers 10 provide very sparse spectra (actually expected population is about 0.1%) for any given parent mass and there are few erroneous overlaps of fragment signals between admitted multiple parent species. The encoding and data analysis strategy may account for specifics of the analysis and for the expected degree of spectra overlapping. For stronger overlapping, the data system 20 may implement either lower duty cycle of gate selecting pulses or a longer data analysis frame.

Expected Effect

In some scenarios, the non-redundant encoding is expected to solve, e.g., unscramble, fragment spectra for the parent ions. In cases of sample depletion, upfront surface scanning with limited analysis time, and/or upfront chromatographic separation, the multiplexed analysis can improve sensitivity and/or speed of the analysis.

In one numerical example, ten encoded gate positions per window G=10, ten encoded delays D=10; one hundred windows per start W=100, and one hundred analyzed starts per sliding analysis frame S=100 were selected. An individual gate (characterized by the gate time from a current start) can be repeated ten times, while any particular pair of gates and delays within unique signal overlapping occurs only once. In contrast, the sequential scanning (one gate and one window per start) would require one thousand starts, with any particular gate being chosen once. At the settings described below, the proposed methods may provide a one hundred fold signal gain, a tenfold faster acquisition cycle, and a hundred fold faster profiling of an upfront chromatographic separation or surface scanning.

Referring to FIG. 1-B, a cylindrical geometry 11C of the MR-TOF analyzer may be implemented instead of a planar geometry of the MR-TOF analyzer 10. In these implementations, the cylindrical geometry 11C provides denser folding of ion trajectories per instrument size. The corresponding increase in flight time and resolution may be achieved without sacrificing sensitivity, which is minimized by non-redundant encoding. As described in WO2011086430 and co-pending application (Client Ref No. 223322-313911), each cylindrical mirror 12C is formed by two sets of coaxial ring electrodes forming a cylindrical gap between them. A periodic lens 14C is wrapped into a ring and a central ion trajectory 19C is aligned on a surface of a cylinder. As an example, a 1 m long and 30 cm diameter analyzer provides 100 m flight path at 10 mm pitch of the periodic lens 14C. The cylindrical analyzer 11C may be constructed using either metal rings separated by ceramic spacers and either aligned with precise insulating rods, or glued/brazed using metal aligning rod technological fixtures. Additionally or alternatively, metal electrodes may be constructed based on ceramic cylindrical holders. Additionally or alternatively, radial groves are made in ceramic or antistatic plastic (like Semitrons) cylinders and spacing between groves is coated with conductive material to form effective electrodes.

Ion Path in MR-TOF

In some implementations, the same multi-reflecting TOF (MR-TOF) analyzer 10 is employed for both stages of tandem MS-MS analysis, while passing parent and fragment ions through the same MR-TOF along different trajectories or along the same trajectory but at the reversed direction, or along the same trajectories but being separated in time.

FIGS. 2-A-C illustrate a multiplexed tandem MR-TOF 11 according to some implementations. In FIG. 2-A, the MR-TOF 11 can include a pass-through CID fragmentation cell 24 (detailed in FIG. 6) located in the middle of an MR-TOF analyzer 10. In the implementations of FIG. 2-B, a multiplexed tandem MR-TOF 11 includes an SID fragmentation cell 26 (detailed in FIG. 5) located in the middle of an MR-TOF analyzer 10. In the implementations of FIG. 2-C, the multiplexed tandem MR-TOF 11 comprises an SID fragmentation cell 28 (detailed in FIG. 4) located at far side of an MR-TOF analyzer 10. It is noted that the MR-TOF 11 depicted in FIG. 2 employs same notations as the MR-TOF 11 depicted in FIG. 1. Variants are designed to match cell requirements at different arrangements of the flight path.

FIG. 3 illustrates an example of a multiplexed tandem MR-TOF 11. In some implementations, the multiplexed tandem MR-TOF 11 includes an external SID fragmentation cell 37 coupled to the MR-TOF analyzer 10 via a curved isochronous inlet 32 made of electrostatic sector segments. For convenience and to enhance differential pumping, the pulsed source 15 may be coupled to the MR-TOF analyzer 10 via a symmetric curved isochronous inlet 32. Ions may be steered by an end deflector 34. As a result, prolonged ion trajectories 35 and 36 corresponding to multi-reflecting paths in both drift directions along the Z-axis may be realized for parent and fragment ions. By employing an even number of lenses in the lens block 14, the full ion trajectory connects curved inlets 32 and 33.

In operation, the source forms ions with multiple m/z ratios (also referred as masses) corresponding to multiple analyte species. Ion packets of plural mass parent ions are pulsed ejected from the pulsed source 15, pass through the curved inlet 32, travel along the trajectory 35 (back and forth in the drift direction Z), and pass through the curved inlet 33, being mass separated by arrival time to gate 16. Multiple packets of parent ions are selected by opening gate 16 multiple times during each source pulse. The admitted ion packets are decelerated to few tens of electron volts (10-50 eV) and hit the SID cell surface. In some implementations, either a spatially fine deflector or an "elevator" past the source adjust the normal collision energy nearly proportional to parent ion mass. In some implementations, the parent mass selection is assisted by an additional "ultrafast" selector 38. Fragment ions are formed in the SID cell (detailed in FIG. 4), pulse accelerated within the cell 37, and pass along the trajectory 36 (same as 35 but in the reverse direction). Since parent ions already have passed the curved inlet 32, the deflecting field of inlet 32 is switched off and ions are allowed to pass onto detector 18 via an aperture in the inlet 32. Alternatively, an annular detector is placed in-front of the source. In service and tuning modes, the inlets 32 and 33 may also have bypass apertures controlled by auxiliary deflectors.

Fragmentation Cells

Figure 4:
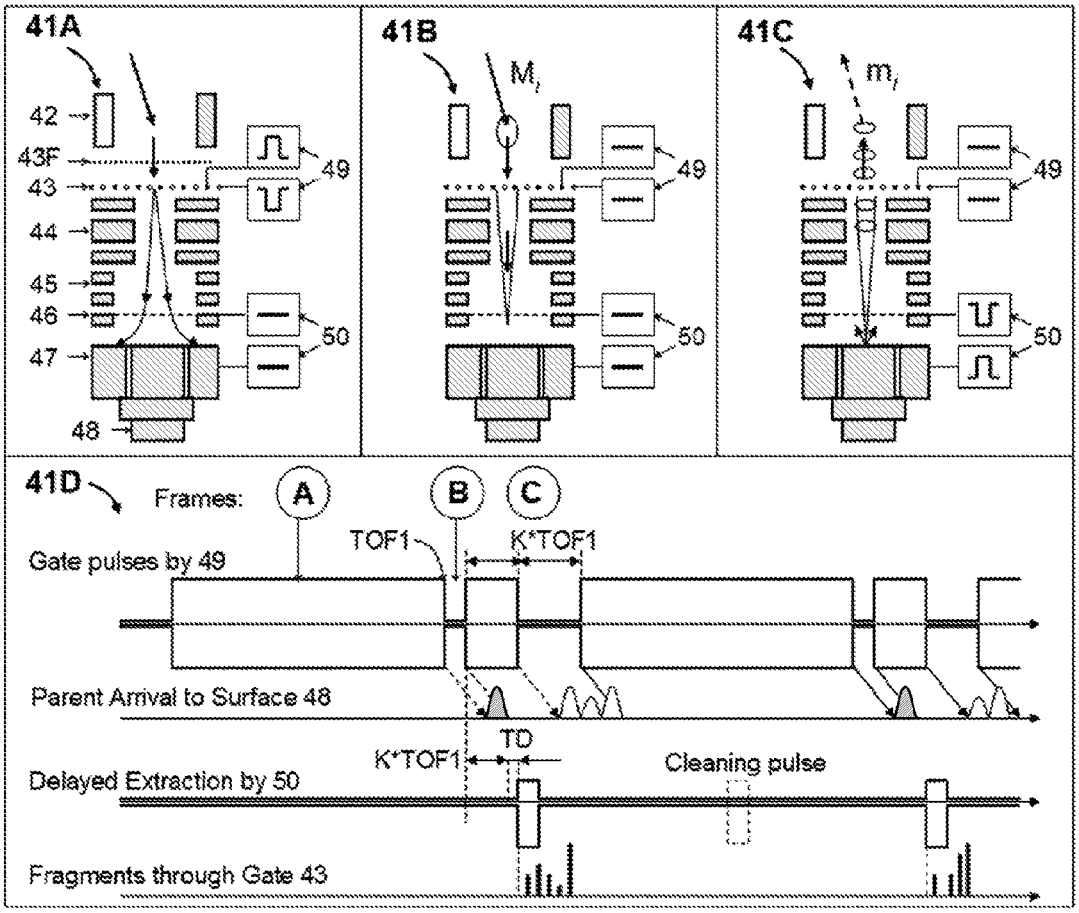
FIG. 4 is a schematic depicting an SID fragmentation cell at various stages of parent ion selection and of delayed extraction of fragment ions in the opposite direction relative to parent ions.

Referring to FIG. 4, an SID fragmentation cell 41 is shown at various stages (A-C) of parent ion selection and of delayed extraction of fragment ions. The SID cell 41 can include an optional static entrance deflector 42, a bipolar wire ion gate 43 connected to a dual pulse generator 49, a fine gate 43F, an entrance lens 44, a static decelerating/accelerating column with nearly uniform field, a mesh electrode 46, and a surface holder 47 with a renewable surface insert 48 forming an electrode. Electrodes 46 and 47 may be connected to a dual pulse generator 50.

In operation, in the state A, the bi-polar wire gate 43 is switched on, i.e., closed. A moderate (⅕ radian) deflection of parents reduces axial ion energy. The subsequent deceleration causes ion gliding along electrode 47. No fragment ions are formed in the open aperture of the accelerator 45. In the state B, the bipolar gate 43 is switched off for 1-2 μs interval. Optionally, very fine gates 43F can be formed by an auxiliary bipolar wire gate 43, e.g., with wires oriented orthogonal to wires of the gate 43. At an expected 1 ms flight time for 1 kDa parents, the resolution of parent ion selection is expected from R1=250-500 if using 1-2 μs gates and 25,000-50,000 if using fine 10-20 ns gates. A sub-millimeter spatial resolution of the bipolar gate provides a resolution of a parent sampling of up to 10-20 ns accounting for 20-40 mm/μs parent ion velocity. To arrange ultrafast sampling, the gate may be flipped from one deflecting state to the opposite deflecting state by one set of bi-polar transistors. The ultrafast sampling may be required in case of ultra-complex mixtures with multiple isobars in a parent spectrum. For purposes of explanation, a strategy with a moderate resolution (250-500) of the parent sampling is assumed.

The admitted ion packets are spatially focused by lens 44, are decelerated by the DC field and hit a surface of insert 48 at ion energy of 10-50 eV. The collision energy may be adjusted nearly proportional to the parent mass, e.g., by a pulsed elevator past the ion source. Note that for the purpose of obtaining analytically meaningful fragment spectra, the initial energy spread of parent ions has been already reduced under 10-15 eV by using weak extraction fields in the ion source 15 of FIG. 3. Fragment ions are formed due to low-energy collisions with the surface 48. To enhance fragment ion gain to 30-40% (relative to 10% gain of pure metal surface), the insert 48 may be coated with a per-fluorated liquid polymer film having vapor pressure under 1.E-7 mBar. In some implementations, the potential of the electrode 46 is kept a few volts, e.g., 1-5 V, lower compared to the electrodes 47 (connected to 48) to assist secondary ions extraction. The secondary ions travel within a 5-7 mm gap of the electrodes 46-47 for approximately 3-10 μs, depending on fragment ion mass. It is noted that the parent ion passage through the mesh 46 forms some secondary ions, which can be back accelerated into the analyzer 10. These ions, however, may be deflected by the bipolar deflector 43.

In the state C, the generator 50 is turned on with a delay of 1 to 3 μs relative to the arrival of parent ions (to be optimized experimentally). The delay consists of two parts: k*TOF1+TD, where TOF1 is the gate open time measured from current start pulse, k is a geometrical coefficient accounting both parent ion passage from the gate and fragment ion propagation from the surface (the relation accounts that heaviest fragment equals to parent), and TD is a variable (between time gates) delay to enhance spectral encoding. The delay, TD, is expected to have approximately 1 μs span for variations, relatively small compared to the propagation time of fragment lions (3-10 μs). Amplitudes of positive and negative pulses of the generator 50 are adjusted such that fragments mean energy stays within the energy acceptance of the MR-TOF analyzer. Typical pulse amplitude is 1 kV. The bipolar gate is open again to transfer fragment ions. Simultaneously (or substantially simultaneously) transferred (leaked) parent ions may not form a signal on the detector 18 because of the properly adjusted length of the second time window also adjusted as k*TOF1. Fragments from leaked parent ions may be removed by a cleaning pulse (shown by dashed line) turned on at the closed state of gate 43.

For the purpose of improving parent ion separation, fine gate 43F allows a much finer ~10-20 ns time scale. As an example, bi-polar wire deflection may be switched from one polarity of deflection to the opposite polarity of deflection. The time fronts may be as low as 10-30 ns if using, for example, bi-polar transistors with a 100-200 V amplitude and a 100-200 MHz bandwidth. By flipping the deflection, the spatial resolution of the bi-polar deflector may be better than spacing between wires, i.e., 0.5-1 mm. At 8 kV acceleration voltage, ions of 1000 amu fly at 40 mm/μs velocity. Thus, spatial resolution translates into a 10-20 ns time resolution of bipolar gates. At a 1 ms flight time, the resolution of parent selection may be brought to approximately 25,000-50,000, unless the resolution is affected by self-space charge occurring at more than 1,000-10,000 ions per packet. The fine gate 43F samples multiple fine notches within the interval of crude gate 43. All resultant fragments are then accelerated by one extraction pulse. A similar fine gate may be used for other cell types.

Figure 5:
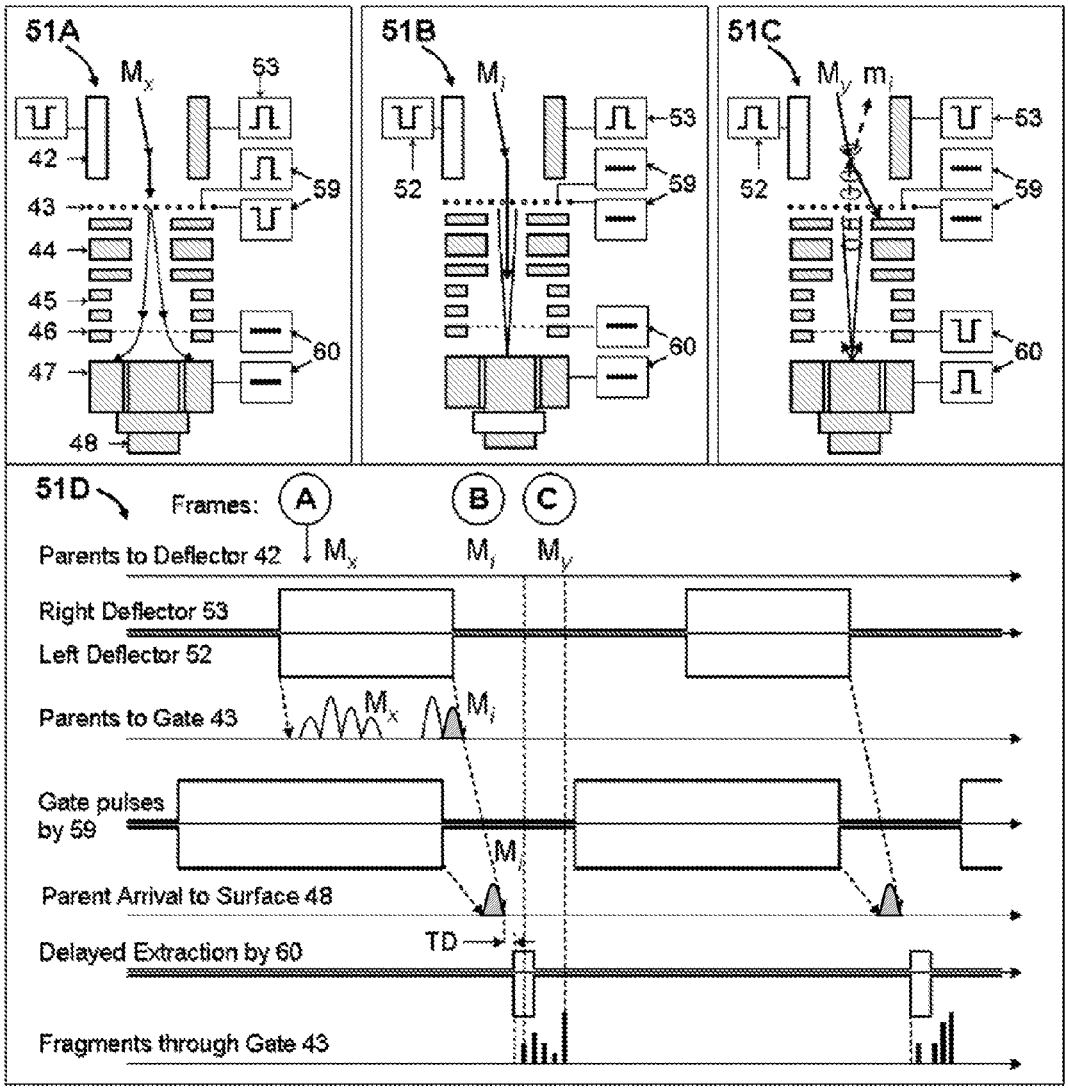
FIG. 5 is a schematic illustrating an SID fragmentation cell at various stages of parent ion selection and of delayed extraction of fragment ions at a right angle direction relative to parent ions.

FIG. 5 illustrates a similar SID fragmentation cell 51 configured for a tandem MS-TOF 11. In some implementations, the SID fragmentation cell is configured for the MS-TOF illustrated in FIG. 2-B. The cell differs from the cell 41 (of FIG. 4) by pulsed operation of the deflector 52 which simplifies synchronization between the parent ion admission in state B and the daughter ion extraction in state C. As a result, gate 43 can be switched once per every gate pulse. Accounting for the currently limited repetition rate of available FTMOS transistors (approximately 100 kHz at 1 kV pulse), the scheme of FIG. 5 may allow for more frequent parent ion admission Vs than the scheme of FIG. 4. Frequency of fragment extraction may also be limited to approximately 100 kHz frequency by time required for both parent and fragment ion propagation through the acceleration column. The above-described scheme with fine timed gate, however, allows a faster admission of multiple parent windows per single fragment ejection pulse.

Figure 6:
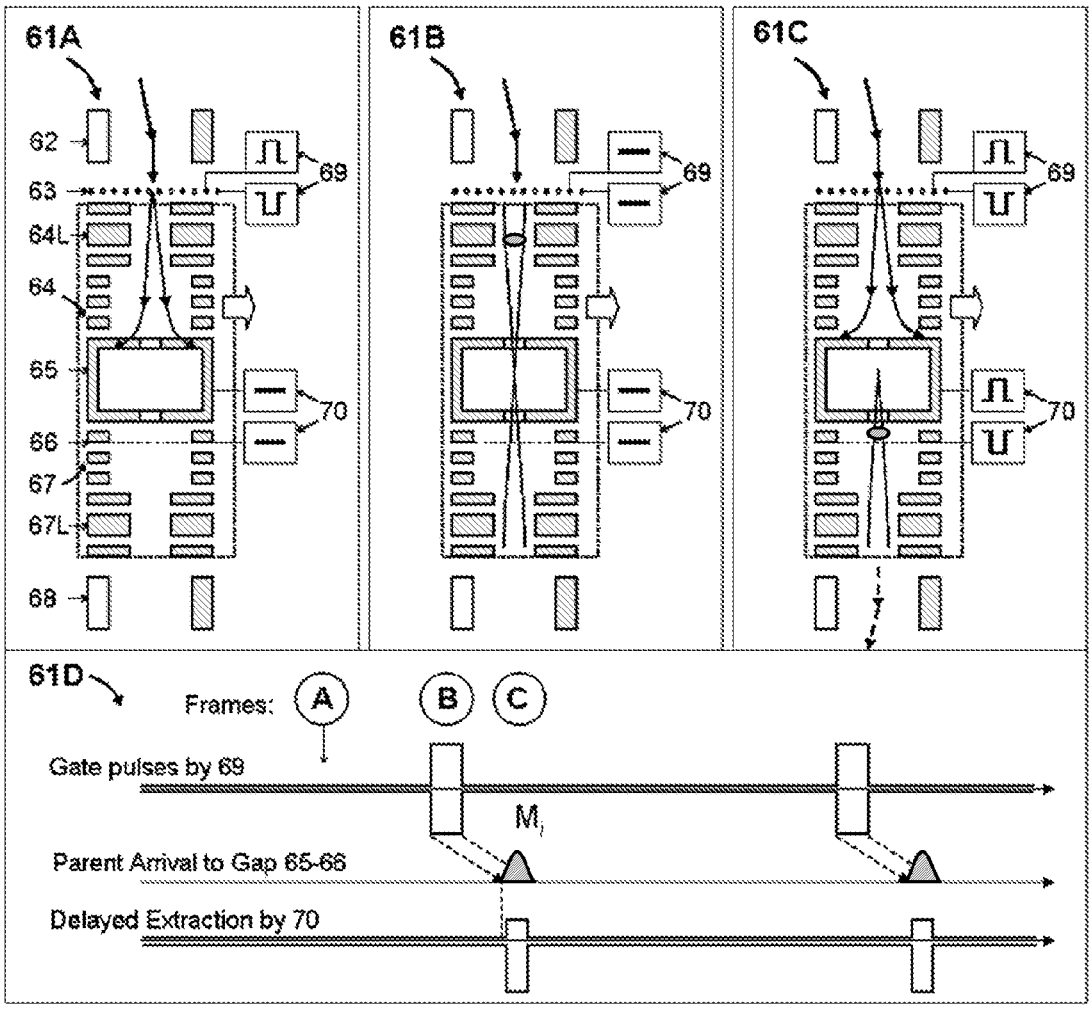
FIG. 6 is a schematic illustrating a pass-through CID cell at various stages of parent ion selection and of delayed extraction of fragment ions.

Referring to FIG. 6, a pass-through CID cell 61 can include static deflectors 62 and 68, a time gate 63 connected to bipolar pulse generator 69, entrance deceleration and exit-acceleration columns 64 and 67 with respective built in lenses 64L and 67L, a gas filled collision cell 65 surrounded by a differentially pumped shroud, and an exit mesh electrode 66. The cell 65 and the exit mesh 66 are connected to a pulse generator 70.

FIG. 6 illustrates three time states (A-C) of the cell 61. In state A, a moderate gate deflection (5-10 degrees) causes ions missing the fine (1-2 mm) aperture of the gas filled cell 65. In state B, pulse generator 69 selects narrow (1-2 μs) time-gates of parent ions. Admitted parent ions are decelerated below 5-10% of initial ion energy (i.e., 100-500 eV), passed through the cell and fragmented in collisions with the rarefied gas. The gas pressure in the cell is adjusted to approximately mid 1 E-4 mBar range in order to induce approximately single ion collision. Medium-energy collisions with gas cause ion fragmentation. Fragments may continue to travel with approximately the same velocity. At a predetermined delay, k*TOF1+TD (depending on parent mass), the pulse generator 70 is switched for pulsed acceleration, while the k*TOF1 delay and pulse amplitudes are selected to adjust fragment energies within 10-15% energy acceptance of the MR-TOF analyzer. A narrow-variable delay TD (within 100-300 ns) may be optionally used for signal-encoding. Ions are DC accelerated in column 67 and spatially focused by lens 67L. The deflector 68 steers fragment packets into the analyzer 10 of FIG. 2C along the folded trajectory 23.

Synchronization

Figure 7:
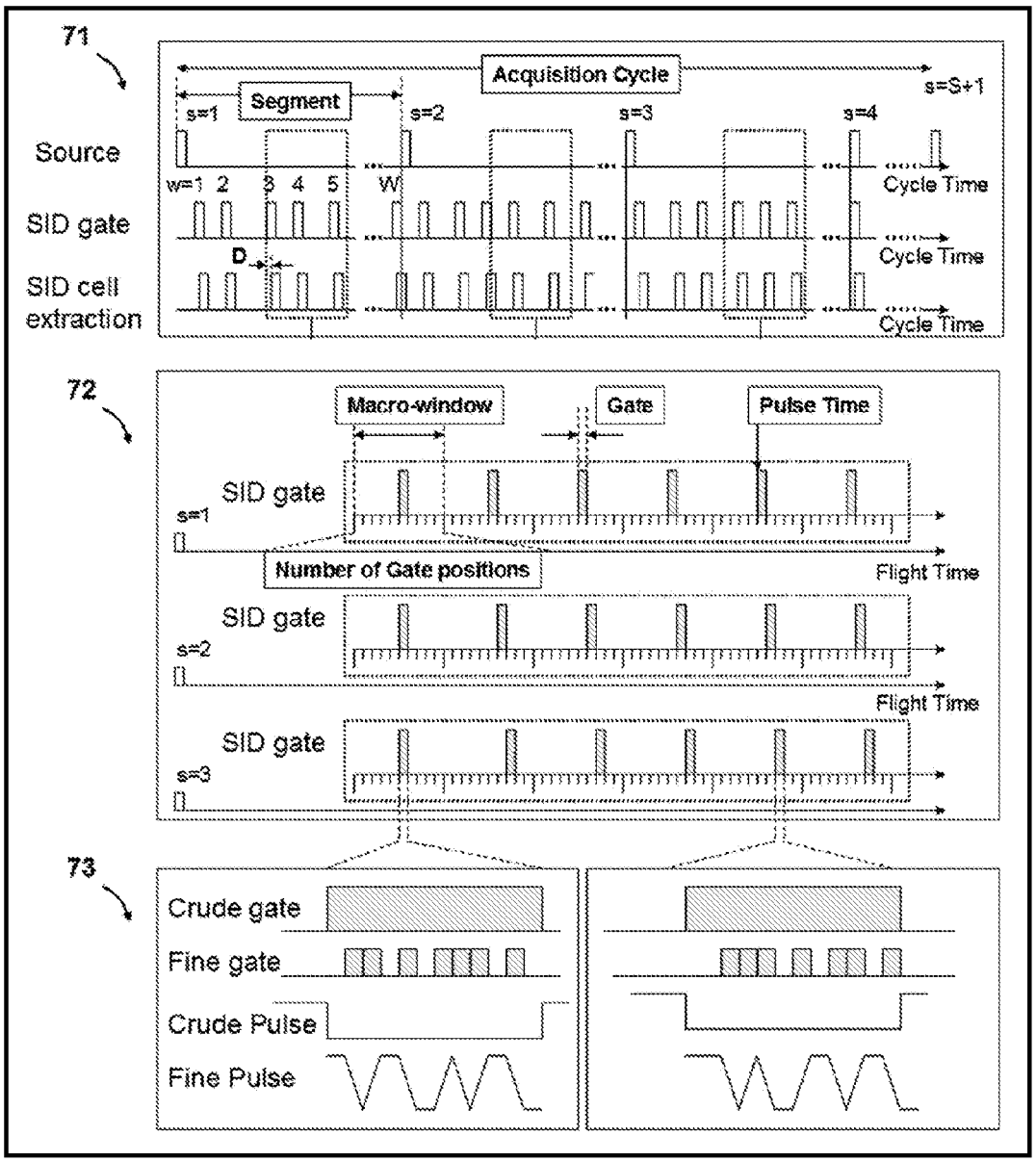
FIG. 7 is a schematic illustrating an example time diagram for synchronization of ion source, of crude and fine time selection gates and of a fragmentation cell.

FIG. 7 illustrates an example time diagram 71 showing the synchronization between an ion source 71A, a time selection gate 71B, and a fragmentation cell 71C. The data acquisition cycle includes S segments, wherein a typical segment time is made comparable to the flight time of heaviest parent ions, approximately 1 ms. The typical number of segments, S, may be chosen from 30 to 300. Within a cycle, there are multiple W macro-windows, each containing one selection gate pulse, where W is chosen from 30 to 1000. Within a macro-window, there are G gate time-positions with an increment ΔT (ΔT=1 μs at W=100 and G=10). The current numbers of segment s, of macro-window w, and of gate position g are denoted in FIG. 7 with lower-case letters. Thus, the cycle time (measured from the beginning of the acquisition cycle) can be calculated according to: Cycle Time=(s*W*G+w*G+g)*ΔT. The flight time of parent ions (measured from the current start pulse) can be calculated according to: TOF1=(w*G+g)*ΔT. The delay between time gate and cell extraction pulses includes two components, k*TOF1+D(s,w,p), where k is a constant coefficient, accounting both the ion passage time from the gate to the cell, and D(s,w,p) is an optional time delay, designed in several increments for the purpose of improving the encoding strategy. The available span of D variations is 1 μs for SID cells and 100-300 ns for CID cells. The diagrams 72 and 73 are zoom views of diagram 71. Diagram 73 presents relative admission intervals of crude and fine gates 43 and 43F, so as actual pulse shapes on both gates. Note that the fine gate forms multiple encoded notches in the crude gate interval, while all the fragments are still extracted by a single SID pulse.

Referring to FIG. 8-A, a diagram 81 graphs an ion signal in coordinates of Cycle Time in relation to TOF1 (parent ion time-of-flight). The dashed line corresponds to parent ions, while filled areas correspond to regions potentially occupied by fragment ions. The region boundaries are drawn as TOF1<TOF1+TOF2<2*TOF1 and account nearly equal flight paths for parent and fragment ions, so as possible emission of non-fragmented parents out of fragmentation cell. A momentarily acquired signal corresponds to a collection of peaks at a current cycle time and may contain signals from plural parent species with different TOF1. The diagram 81 illustrates that a moderate signal overtake (fragment ions arrive within the next following start interval) is acceptable to accelerate acquisition. The period between start pulses may be designed either equal to maximal total flight time max(TOF1+TOF2), maximal first flight time max(TOF1), or a fraction of max(TOF1). The signal originating from any source (start) pulse may arrive within a next time segment. The overtake does not affect the signal decoding efficiency if the spectra are sparse enough. Thus, the start pulse frequency may be adjusted between preformed sets in a data-dependent fashion based on sparseness of acquired spectra.

Multiplexing with Non-Redundant Sampling

Referring to FIG. 8-B, a diagram 83 illustrates example signals of parent and fragment ions (shown as small squares). Focusing on spectral recovery, one parent specie with fragment signals are represented by the black squares. For explanatory purposes, the same parent specie is selected for two consecutive starts. Light squares represent fragment signals from other parent species with gate sampling times being different between starts. The foregoing is representative of a non-redundant sampling method. Ovals show example signal overlaps in the cycle time. Because of non-redundant sampling, the erroneous overlaps are differ between correlated starts (with same gate of interest), while true signals are repetitive.

The signal segment 84 employs color coding to track fragments of interest, where black bars represent fragment peaks for a gate of interest. In experiments, the overlaps may be distinguished in case of partial peak overlap or not distinguished in case of nearly exact overlap. Because of sparse occurring overlaps and because of correlation analysis, the systematically repeating peaks may be separated from erroneous overlaps. Systematically repeating signals appear within segments corresponding to a repeatedly selected parent gate time.

Once fragment peaks are allocated for all parent gates, the spectral recovery may be enhanced by post-analysis of expected overlaps (experiment replay in-silico). The overlapping signals could be either discarded or deconvolved with other fragment peaks of the same parent by correlating chromatographic profiles. If overlaps are discarded, the signal intensity may be adjusted based on relative number of discarded overlaps.

Fine Non-Redundant Sampling

Resolution of parent selection may be enhanced by using a fine gate in combination with a crude gate. As an example, the crude gate selects 2 μs intervals, while the fine gate deflector selects about 5-7 fine time gates with a 10-20 ns interval and 30-50% duty cycle, alternated between starts in a third encoding dimension. Compared to one layer gate, the overall duty cycle of the tandem drops (approximately to 2-5%), but the resolution of a parent selection rises from 500 to 50,000. The second layer of fine gating is suitable for tandem MR-TOF analyses of very complex mixtures, wherein parent ions are densely packed as isobars, signal is no longer sparse, and some rarefied selection of parent ions is required for decoding anyway.

Multiplexing with Delay Encoding

Systematic signal overlaps may be avoided by implementing a sole non-redundant variation of extraction pulse delays. The set of delays can be defined by a non-linear progression, thereby reducing or avoiding repeatable inter-signal intervals. For example, the set of delays may be defined as $TD(n)=TD_0*n*(n+1)/2$, where $TD_0$ exceeds the typical peak width in TOF2. In other words, the delay set is formed with linearly progressing intervals proportional to $n*(n+1)/2$ with an integer index n. If, for example, $TD_0=10$ ns (expect peaks with FWHM<5 ns at TOF2=1 ms and $R_2=100{,}000$), the set of delays is expressed as 0, 10, 30, 60, 100, 150, 210, 280 (n=8), 360, 450, 550, 660, 780, 910 and 1050 ns (n=15). As can be appreciated, the forgoing results in unique delays and unique time differences between delays. During the delay encoding, the gate synchronization may be simplified. As an example, a comb of equidistant gates may be set to a constant value, while the source pulse is delayed between starts for C times corresponding to the number of comb shifts. The analysis with non-redundant multiplexing is then repeated for each comb position. The all-mass analysis can take C repetitive analyses blocks.

According to some implementations, the delays may be set to increase progressively with the number of window. Accounting, however, for the limitation of the delay time (<1 μs for a SID cell, <0.3 μs for a CID cell), the number of windows would be limited, e.g., less than 8 for CID cell and less than 15 for SID cell. Such a reduction in windows may limit the multiplexing gain, the sensitivity and the resolution of parent selection. In some implementations, the delay sequence may be unique for every segment (i.e. interval between adjacent starts), such that a unique sequence of delays appears for any gate within the acquisition cycle containing multiple segments. To avoid redundancy, the delay table can be formed by using the transposed version of the encoding matrix built from a set of mutually orthogonal matrix blocks.

Double Encoding

According to some implementations, two types of non-redundant encodings may be combined, i.e., employing both—non-redundant sampling (NRS) by parent selection gates and by encoded frequent pulsing (EFP) formed with encoding of time delays of fragment extraction. In these implementations, a reduced number of gates positions per window and a short delay set may be employed. Details of the double encoding method are described below for particular examples.

Encoding Matrices

The capability and potential of the non-redundant multiplexing schemes depend on the existence and properties of non-redundant encoding matrices. Such matrices (denoted as M) should satisfy the non-redundancy condition:

$$(M_{i,j},M_{a,j})\neq(M_{i,b},M_{a,b}) \quad (1)$$

for $\forall i\in 0 \ldots (W-1)$, $a\in 0 \ldots (W-1)$, $i\neq a$; $j\in 0 \ldots (S-1)$, $b\in 0 \ldots (S-1)$, $j\neq b$; where W is the number of parent ion windows, S is the number of segments (starts) in acquisition cycle, i,a are indexes of window, and j,b are indexes of segments. According to some implementations, the non-redundant encoding matrix further satisfies the condition that it can be built from a set of mutually orthogonal Latin squares in a manner consistent with the principles of Latin Hypercube sampling. A Latin square is an n×n array filled with n different symbols, each occurring exactly once in each row and exactly once in each column. It is noted that the matrix M is suitable for encoding even if condition (1) rarely fails, i.e., low redundancy is present. In this case the decoding is based on the fact that the number of coinciding signals for the gate position being decoded is at least twice the number of coincidences with signals of other gate positions.

FIG. 9-A illustrates matrix annotations and principles of NRS matrix construction. It is noted that the acquisition cycle contains multiple segments measured from start to start of the ion source. The segment is divided onto multiple window intervals, and each window interval is divided onto multiple gate intervals. Capital letters S, W, and G stand for number of segments per cycle, windows per segment, and gates per window, while small letters s, w, and g correspond to current indexes of segments, windows and gates. In an example, the current window is #w, the next window is #w+1, and each window has 10 gate positions, i.e. G=10. In the example matrix 91, the numbers in the matrix cells represent the status of the gates, e.g., 1 indicates an opened gate and 0 indicates a silent gate. The non-redundancy is illustrated by example matrix 91, wherein the same combination of gates in same pair of windows is forbidden in any two segments s=i and s=j of the entire acquisition cycle. The example matrix portion 92 shows a reduced method of cell annotation, wherein number within the cell annotates the current number of the open gate. Matrix 93 presents an example of Latin square for W=5 and G=5. An example Latin square matrix 95 has a set of (W−1) mutually orthogonal Latin squares, where W=5. In the case of multiplexing by delay encoding, a transposed matrix 96 equivalent of matrix 95 can be used. It should be appreciated that both windows and delays may be encoded with similar types of non-redundant matrices.

The following pseudo code in Table 1 illustrates an example algorithm for generating a set of (W−1) mutually orthogonal Latin squares for building of non-redundant encoding matrix M.

TABLE 1

```
Int a = 0;
for (int k = 0; k < W; k++)
{for (int j = 0; j < W; j++) {for (int i = 0; i < W−1; i++) {M[i+k*W] [j] =
a; a++; if (a >= W) a = 0;} a += k+1; if( a>=W) a −= W;} }
```

According to the algorithm shown in Table 1, the columns in each block are generated by the application of a linearly-progressed shift. The shift value is equal to the number of blocks increased by 1. The main properties of non-redundant matrix M are: (a) each number is unique within a row, (b) each number is unique per column within each block, (c) equal frequency of numbers occurrence, and (d) non-redundant structure meets the requirements of condition (1).

In order to increase the dimension of a matrix M, e.g., matrix 93, the number of cells is increased proportionally, e.g., increasing the number of delays or gate positions per window. Increasing the number of gate positions can reduce the duty cycle. Furthermore, the number of delays is limited by processes in fragmentation cells. To overcome the limitation, the MS-TOF implements a combination of two multiplexing methods, i.e., sampling and delay encoding.

In case of combined encoding, each element of encoding matrix M can be written as a pair of numbers denoting variable gate positions and delays. A matrix can be built from a non-redundant matrix M by means of the following transformation: each element of matrix M can be considered as a number represented in numeral system of base D, where D is the number of available delays. Referring to matrix 98 in FIG. 9B, a first digit represents the number of gate position in the window and second digit represents the number of delay.

Referring to FIG. 9B, a matrix transformation for combined encoding is illustrated in matrices 97 and 98. Initial matrix M, i.e., matrix 97, is built from a set of mutually orthogonal Latin squares and is suitable for orthogonal sampling within 7 windows at 7 gate positions (overall 49 gates positions) for 42 shots, wherein each individual gate (combination of window number and gate number) is repeated 6 times.

The combined encoding allows the reduction of the number of gate positions from seven to four by introducing two delays or from seven to three by introducing three different delays. The latter case is shown in the matrix 98. The matrix is transformed by representation of each element in numeral system of base 3.

A similar transformation of a matrix M can be used for the case of encoding by combining of more than two types of multiplexing, e.g., by adding ultrafast gates. In this case the numbers in the cells may include three or more digits.

By combining two or more types of multiplexing, the dimension of non-redundant matrix can be increased without sacrificing experiment parameters. In an example, G is set to ten gate positions per window G=10 and a set of eleven delays D=11. This allows use of a matrix having 100 Latin squares and a size 101×101. The number 101 is selected as the nearest prime number less than G×D, i.e., 110. The matrix can be cropped to 100×100 to bring the number of windows equal to 100. The overall number of individual gates is 1010 and the number of available non-redundant trials (starts) is 10100. Because the number of available non-redundant starts is large, the starts may be filtered to satisfy some experimental requirements, like smooth variations of pulse intervals. The duty cycle of the experiment is 10% and the time resolution of parent selection is 1010. The number of starts required for decoding the fragment spectra of all of the gate positions is 101 and the experiment time is 102.01 ms, while the average time between individual gate repetitions is 10 μs. It is noted that the foregoing is provided for example only.

False Positives and False Negatives

The described encoding algorithms heavily rely on a sparseness of the MS-MS data. Typical peptide fragment spectra are known to contain relatively few, e.g., three or four, to tens of major peaks and from tens to more than a hundred minor peaks. For example, the average number of fragment peaks for a single parent ion may exceed 100. At a resolution of 100,000 at the second MS stage, the spectral population (percentage of occupied time-of-flight scale) is expected in the 0.1% range. The number of gates per start is approximately 100 and is mainly limited by a frequency range of currently available FTMOS transistors. Thus, the population of the recorded signal is expected in the 10% range. A subsequent in-silica replay of the experiment with accepted true peaks can allocate the major portion of the occurred overlaps, thus removing spectral distortions due to encoding. For optimizing the encoding strategy more accurate estimations should be made for positive and false positive identifications.

The probability function for a peak to be non-overlapped in a segment spectrum is:

$$p_{NO}=(1f_p\cdot\rho)^{W-},$$

where $f_p$ is frequency of occurrence of parent ion in a gate, defined as $$f_P=\frac{P}{W\cdot G},$$

ρ is population of fragment spectrum per single gate, W is the number of windows per segment, G is the number of gate positions per window, and P is total number of parent ions in the spectrum. The population of the segment can be determined according to: $\rho_s-1-(1-f_p\cdot\rho)^W$.

Decoding of a fragment spectrum for particular gate g is performed the following way:

1. During the acquisition cycle, a set of segments containing fragment spectra of gate g is selected. When using encoding matrix of W×W(W−1) size, out of total W(W−1) segments there are N segment spectra of a total W(W−1) segments containing any particular gate, where N≤W (property of matrix). An example of a set of segments for gatw 1 of window 2 is shown at 94 of FIG. 9-A.

2. A delay correction is applied to align the spectra according to the delay used at gate g in each of the segments.

3. The spectra are searched through for coinciding peaks. Such peaks are summed into the fragment spectrum of gate g. A peak is considered coinciding if it is found in at least K spectra of N. The value of K can be selected such that K is greater than an expected number of random coincidences with signals of other gates.

It is noted that the summed peak may contain signal of a foreign overlapping peak. The point of this estimation is to search for an encoding strategy where the probability of such overlap remains small.

The probability of positive identification, i.e., having at least K peaks free of overlaps, can be determined according to:

$$p_D=\sum_{j=K}^{N}C_N^j\cdot(p_{NO})^j\cdot(1-p_{NO})^{N-j}.$$

The probability of false positive identification composed of K and more random peaks from different gates is:

$$p_F=1-\sum_{j=0}^{K-1}C_N^j\cdot(p_S)^j\cdot(1-\rho_S)^{N-j}.$$

Encoding Example 1

Referring to FIG. 10-A, table 101 shows example encoding parameters while using non-redundant sampling (without delay encoding) with 25 gates positions. The foregoing allows the use of 25 windows: W=25, G=25, D=1. The duty cycle is DC=4% and the mass resolution of the parent selection is 312, i.e., RS=W*G/2. The encoding matrix has 25 columns and 100 rows, i.e., the number of starts is S=100 and each gate is repeated every 25 shots. Diagrams 102 and 103 present the probability of a false negative identification (solid line) and of false positive identification (dashed line), both as a function of number of matching K peaks for an overall number of parent ions P=100 in diagram 102 and P=1000 in diagram 103. For simulating those diagrams the average population of fragment ions per one parent is assumed at ρ=0.001. By setting the acceptable probability threshold equal to 1%, the range of acceptable K is from three to seven at P=100 and from 3 to 6 at P=1000.

Encoding Example 2

Referring to FIG. 10-B, table 104 shows example encoding parameters while using non-redundant delay encoding (without gate encoding) with a set of 15 delays. The foregoing allows forming up to 210 non-redundant windows. Because cell operation and maximal frequency of extraction pulses (limited by FTMOS transistors) require selecting at least 5 gates in 10 μs windows, gate shifts are introduced. As an example, one may use variable delay of the source and a comb of 2 μs long gate pulses with 10 μs period. The number of formed effective comb shifts is denoted by C=5. Overall, W=210, G=1, D=15, and C=5. The duty cycle is DC=20% and the mass resolution of a parent selection is 525, i.e., RS=W*C/2. The encoding matrix has 210 columns and 15 rows, i.e., the number of starts is S=15. The acquisition cycle, though has to be repeated C=5 times, i.e., overall acquisition takes 75 starts. Any particular gate is repeated 5 times within a block with the same shift. Diagrams 105 and 106 present the probability of false negative (solid line) and of false positive (dashed line) identifications as a function of number of matching K peaks at overall number of parent ions P=100 in diagram 105 and P=1000 in diagram 106 at the average population of fragment ions per one parent being ρ=0.001. By setting the acceptable probability threshold equal to 1%, the range of acceptable K is from three to thirteen at P=100 and from seven to eight at P=1000.

Encoding Example 3

Referring to FIGS. 10-C and 10-D, tables 107 and 110 show encoding parameters while using a combined non-redundant delay and gate encoding at two settings: in the first setting, shown in table 107, G=17; D=6 (C=1). In the second setting, shown in table 110, G=6 and D=17. In both cases C=1 and the number of non-redundant windows is W<102. W is set to 100 to form 100×200 matrices, i.e., the number of starts per cycle is S=100. The second case improves the duty cycle (from 6% to 17%) and accelerates profiling (gate occurs every 6 starts Vs 17 starts). The resolution of the parent selection, however, was reduced in the second scenario (from 850 to 300). Diagrams 109 and 112 present the probability of false negative (solid line) and of false positive (dashed line) identifications for two cases (diagram 109 for G=17 and D=6 and diagram 112 for G=6 and D=17) as a function of number of matching K peaks at overall number of parent ions P=1000. In the first scenario when P=1000, the average population of fragment ions per one parent is ρ=0.001. By setting acceptable probability threshold equal to 1%, the range of acceptable K is wide enough at both P=100 and P=1000. Because identification is reliable for large number of parents P up to 1000, in case of smaller P a faster analysis and a weaker encoding method may be accepted having weak resonances or a limited number of repeated overlaps.

Comparing Encoding Examples

All the encoding methods are feasible for TOF-TOF analysis of extremely complex mixtures wherein ion source simultaneous emits up to 1000 parent species. The encoding solely by gate sampling either limits resolution of parent selection or drops duty cycle of the analysis. The encoding solely by extraction delays requires at least 10-15 gate positions which prohibit using CID cell, since extraction may be asynchronous for less than 300 ns. The combined encoding is most flexible and allows reaching best combination of TOF-TOF parameters.

Parameters of TOF-TOF

Parameters and settings of tandem TOF may be adjusted depending on the sample complexity. Low complexity samples (single protein digest, synthetic mixture, etc) are unlikely to require parallel MS-MS. A high-throughput tandem is particularly desired for analyses of medium to high-complexity samples, like metabolomics, petroleomics and proteomics samples, wherein number of identified components varies from tens of thousands to ultimately millions. It is expected that tandem mass spectrometry is preceded by a chromatographic separation (LC, GC and GCxGC) with separation capacity from 100 to 10,000. Thus, the encoding strategy should either have 10-100 ms, or allow recovering time profiles within decoded signal series, which also poses limits onto encoded signal strings due to speed and memory at signal analysis. As will be shown, longer acquisition cycles and combined NRS and EFP encodings provide better results. It will be also apparent that in all cases higher duty cycles are achieved at lower resolutions of patent selection. The compromises should be chosen based on analysis type.

FIG. 11 illustrates a table 1100 of example settings and parameters of a tandem MR-TOF. The settings of the tandem MR-TOF may be chosen between sensitivity and speed (desired at moderate sample complexity) against parent selecting resolution (desired at high sample complexity). When estimating parameters the following relations may be used: multiplexing gain=W/C, i.e., number of windows divided by number of comb shifts (employed in delay encoding only); the duty cycle DC=DC(F)/G/C, where G is the number of gate positions and DC(F) is the duty cycle of fine gate sampling; selection mass resolution RS=W*G*F*C/2, where F is the number of fine gates positions; profile time resolution=TOF1*G/C, i.e., period of individual gate occurrence; and cycle time=S*TOF1 and depends on the encoding matrix height (number of rows) which in turn depends on encoding type. It is worth noting that most of parent ions are expected to appear in fragment spectra and thus, their resolution will equal to R2 in the order of 100,000 to 400,000. However, at high sample complexity a moderate parent separation (typical R=500) is likely to cause chimera fragment spectra, i.e., spectra containing multiple fragment spectra from different parent species with close m/z. The expected sub-ppm mass accuracy will definitely help partial separation of chimera spectra when grouping fragment peaks either by elemental content or using chemical exclusion rules (e.g., account accurate masses of amino-acids). One may also expect an incomplete set of parent ions, which will not fill all the sampled windows. Those effects may be converted into encoding strategies providing either higher duty cycles or higher resolution of parent selection for improved confidence in MS-MS data. To improve parent separation a third layer encoding of fine gates can be applied to increase separation of parent ions to a resolution level of 10,000-50,000. Switching between strategies may be performed automatically by sensing threshold sparseness of the acquired signal.

In table 110, examples 1 and 2 correspond to CID cells, where the number of delays is limited to D<5-8. Compared to the pure gate encoding (example 1) the combined encoding (Example 2) provides higher resolution of parent selection and allows using larger number of parent ions. Examples 3 to 6 correspond to SID cells. Sole gate encoding (example 3) provides a lower duty cycle compared to combined encoding (examples 5 and 6), while sole delay encoding (example 4) does not allow analysis of very complex mixtures. Combined encoding may be chosen to provide a larger duty cycle (example 5) or better parent selection (example 6). Example 7 presents usage of fine gates, which allows dealing with extremely complex mixtures, improves parent ion selection to RS=10,000 but may decrease the duty cycle and slows down the acquisition and profiling.

The examples also present different configurations for analyzer (longer flight path and higher energy improve R1 and R2 up to 800,000) and cell selection (CID Vs SID and in different ion trajectory settings). Example analyzer parameters are selected such that the average period between pulses is set to 10 μs.

In all the examples, the duty cycle of all-mass MS-MS varies from 3% to 17%, the mass resolution of parent selection varies from 300 to 10,000 (compare with RS=100-200 in conventional tandem operation), the mass spectral resolution is above 100,000, and the multiplexing gain varies from 25 to 200. The combination exceeds parameters of modern tandem MS because of their sequential parent selection.

Data Dependent Encoding

Term 'data dependent' can include signal acquisition strategies that may be adjusted in real time, before the encoding and/or decoding steps, or at last before the step of fragment spectra interpretation, which is usually done in batches and accounts multiplicity of identifications across the entire LC-MS-MS analysis. Because an optimal acquisition strategy depends, at least in part, on the overall signal sparseness, and such sparseness may be measured prior to signal decoding, a data dependent adjustment (switch) of encoding sequences may be considered to improve identifications. Such strategy may use an increased frequency of start pulses and wider gates for very sparse signals, so as reduction of gate numbers or switching to fine gate sampling at too dense signal.

Because parent ions are recovered in decoded spectra, the presence of chimera spectra may be monitored prior to interpreting fragment spectra. Indeed appearance of several parent masses within the selected parent mass window would reliably tell appearance of chimera spectra (not vice versa since parent ions may be missing). Relatively high population of decoded spectra may be another indication of chimera spectra. In both cases, the decision may be made on a fly, before doing identification step. The encoding algorithm may be switched and the fine gating may be turned on to separate parent isobars. One may also envision robust alternating regimes wherein several encoding sequences are combined sequentially and repeatedly.

Analog Encoding

The above described multiplexing methods rely on digital encoding of gate position and of extraction pulse delay. As shown by the matrices properties in FIGS. 10A-D, the decoding capability is far from being stressed to its limits. In case of moderately complex analyte mixtures, the signal is so sparse that one may use methods which have less efficient non-redundant encoding, but may be readily implemented with simpler circuits or data systems. For example, delays of gate and extraction pulses may be varied by Sinus wave signals, preferably orthogonal in frequencies, such that resonance between signals occurs once or very few times per start. Such Sinus generators may be forced to shift phase or frequency by their driver, or if running in a free mode the generators may be synchronized by properly delayed exciting pulses. Then the actually occurred gate and pulse timing may be measured by a separate data channel.

Upfront Separations

As shown in FIG. 11, in-spite of fairly prolonged acquisition cycles (25-1000 ms, depending on sample complexity), any single gate is frequently (10 μs/DC~6-250 μs) sampled. Once fragment spectra are recovered, chromatographic profiles may be reconstructed as peak intensity profiles. It is expected that the tandem parallel MR-TOF instrument is suitable for such relatively fast chromatographic separations as LCxCE (with sub-second peaks) and GCxGC with 50 ms peaks. More powerful chromatography eases the requirements onto non-redundant encoding and shorter encoding sequences or faster source pulsing may be used.

Even faster up-front separations may be used when specially designing the analysis strategies. As one example an $MS^3$ mass spectrometer may employ a relatively slow scanning (1-2 second per scan) parent MS1 separator, while MS2 and MS3 stages are performed with NRS TOF-TOF. As another example, an ion mobility (IMS) with typical separation time of 10-100 ms and peak width from 100 to 500 μs may be combined with parallel MR-TOF if: (a) strobe-sampling IMS output at multiple IMS repetition cycles; (b) sampling and accumulating IMS fractions into a set of radiofrequency traps with subsequent slower release of IMS fractions; or (c) accelerating tandem MR-TOF operation either by using shorter flight times, arranging faster repetition of source pulses at a cost of larger spectral overtake, and/or by using fewer gates at a cost of lower resolution of parent selection, while capitalizing on lower requirements for tandem parameters when using IMS separation.

Multiplexed Mass-Spectral Analysis

While the principle of non-redundant encoding of sparse signals is described for tandem MR-TOF, the present disclosure is applicable to a wider range of mass spectral methods and apparatuses. As an example, a magnet-sector mass spectrograph may be used to generate multiple beams of mass separated ions within a focusing plane. An array gate may be used for selecting a set of parent species which are then introduced into a fragmentation cell (CID or SID), preferably assisted by RF confinement in gas. Total fragment spectra may be acquired by a parallel mass spectrometer, such as MR-TOF or magnet spectrometer with an array detector. Another example is MALDI-TOF mass spectrometer with fragment analysis by a post-source decay (PSD), where non-redundant subsets of parent ions may be formed by rapidly switching TIS. In another example, multiple mass windows of parent ion of may be admitted into a fragmentation cell, and "chimera" spectra containing mixtures of multiple fragment spectra may be acquired on high resolution instruments with slow signal acquisitions such as FTMS, electrostatic traps or orbital traps. In another example, distinct sparse spectra may originate from other separators or sources such as: (i) simultaneously emitting pixels of profiled surfaces; (ii) a set of ionization sources; (iii) a set of fragmentation cells; (iv) a pulsed trap converter followed by an ion mobility separator; and (v) a parallel mass analyzer separating ions in time, like ion trap with mass selective release, time-of-flight mass analyzer, or a mass spectrograph. Tandem TOF and above described tandem MR-TOF are particular cases. The sources are then understood as TOF or MR-TOF separated ion packets and mass spectrometer as any TOF MS. TOF analyzers may comprise any combination of drift spaces, grid-covered ion mirrors, grid-free ion mirrors and electrostatic sectors.

The non-redundant multiplexing method relies on signal being either constant or repetitive during acquisition of multiple mass spectra. It also relies on ion flows being sparse, either spectrally, spatially or in time such that relatively small portion of signals is overlapping between sources. The non-redundant principle may be applied to mass spectrometry regardless of the instrument type. Non redundant sampling may be arranged from: (i) ion flows from multiple ion sources; (ii) ion flows multiplexed downstream from a single ion source, said multiplexing could occur in the ion transfer interface, ion mobility cell, intermediate trap, fragmentation cell, multiple RF ion guides; (iii) ion packets generated by multiple pulsed converters; (iv) ion packets generated by single pulsed converter and separated in time by ion m/z.

Figure 12:
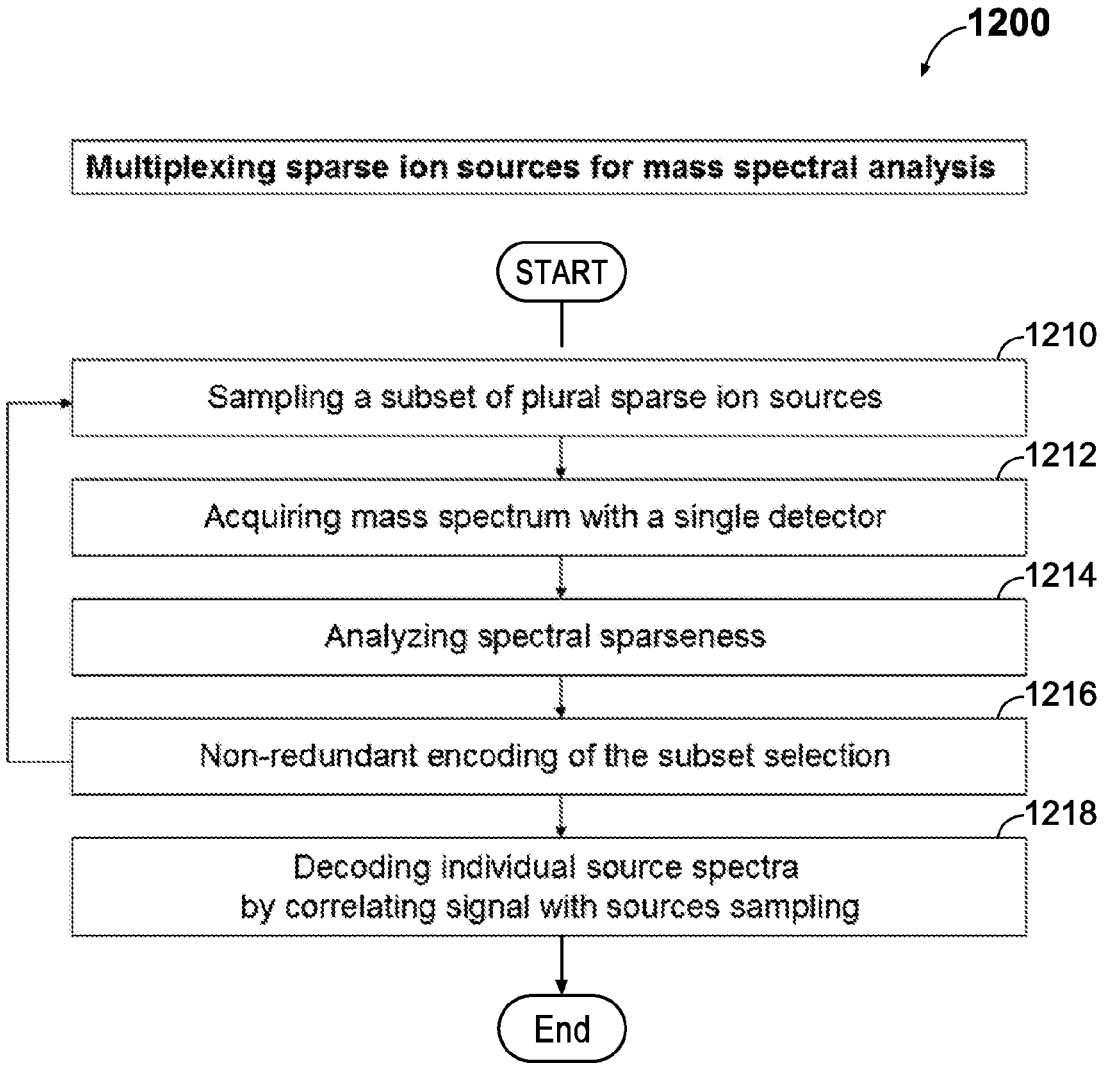
FIG. 12 is a schematic illustrating a generic method of non-redundant multiplexing of multiple sources of sparse repetitive or continuous signal.

FIG. 12 illustrates an example set of operations for a method 1200 for performing multiplexed mass spectral analysis. At operation 1210, ions are sampled to form a subset of plural ion sources. The sources form sparse and repetitive ion flows with limited spectral signal overlapping. At operation 1212 a mass spectrum is recorded by a single detector. At operation 1214, the spectral sparseness is analyzed, and at operation 1216, non-redundant encoding of the sampled ions is performed. It is noted that operations 1212-1216 may be repeated while varying the subsets in a non-redundant fashion, where combinations of any two simultaneously sampled sources are unique, while any particular source is sampled multiple times. At operation 1218, the spectra from all individual sources are decoded by correlating the encoded signal with the source sampling. In some implementations, the encoding step may be automatically adjusted based on the mass spectral sparseness. Non-redundant sampling matrices can be based on mutually orthogonal Latin square matrices. Further, the decoding can be assisted by overlap in-silica reconstruction. In some implementations, the non-redundant sampling is complemented by non-redundant encoding of ion flow delays.

According to the present disclosure, multiple useful analytical regimes may be implemented. For example, an MS-only regime, wherein ions are electrostatically reflected from SID cell or passed through vacuum CID cell, thus reaching maximal resolution and mass accuracy of mass analysis may be implemented. The number of injected ions into the analyzer is alternated between low and high gain, such that to bypass space charge effects within the analyzer (affected by space charge of narrow mass range) and thus to provide enhanced mass accuracy and resolution within wide dynamic range. Preferably, an upfront mobility separation is employed for selecting temporary narrow mass range which would allow frequent ion injection into the MR-TOF analyzer without significant spectral overlapping. The regime is useful for high throughput characterization of the mixture, determining accurate parent masses and for determining selection windows in a data dependent regime described below. Furthermore, according to the example of parallel, all-mass tandem MS analysis, FIG. 11 illustrates a range of parameters for such analysis, which may vary from regimes with large duty cycle (up to 20%) at low resolution of parent separation (few hundreds) to a less sensitive but more specific analysis with higher (1000-2000) and yet much higher (10,000-20,000) resolution of parent selection. The present disclosure may be further applied to a high throughput and sensitive (DC>20%) regime with low resolving TOF1 (R1=100). In these implementations, fragment spectra are reconstructed based on a selection of parent mass window and on the time correlation of chromatographic separation. Additionally or alternatively, the present disclosure may be applied to an exploration implementation with a high resolution of parent selection (R1>10,000) for looking at close isobars. Such exploration may be done sequentially for reliability in parallel fashion with non-redundant sampling for higher throughput. Moreover, the present disclosure may be applied to data dependent acquisition, which is widely employed in current MS-MS instrumentation. Furthermore, a MS3 regime may be implemented if using an additional upfront separator, such as an IMS or mass separator. It is noted that a TOF-TOF tandem makes MS2 and MS3 stages highly parallel and fast, thus making MS3 practical.

Various implementations of the systems and techniques described here can be realized in digital electronic and/or optical circuitry, integrated circuitry, specially designed ASICs (application specific integrated circuits), computer hardware, firmware, software, and/or combinations thereof. These various implementations can include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device.

These computer programs (also known as programs, software, software applications or code) include machine instructions for a programmable processor, and can be implemented in a high-level procedural and/or object-oriented programming language, and/or in assembly/machine language. As used herein, the terms "machine-readable medium" and "computer-readable medium" refer to any computer program product, non-transitory computer readable medium, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term "machine-readable signal" refers to any signal used to provide machine instructions and/or data to a programmable processor.

Implementations of the subject matter and the functional operations described in this specification can be implemented in digital electronic circuitry, or in computer software, firmware, or hardware, including the structures disclosed in this specification and their structural equivalents, or in combinations of one or more of them. Moreover, subject matter described in this specification can be implemented as one or more computer program products, i.e., one or more modules of computer program instructions encoded on a computer readable medium for execution by, or to control the operation of, data processing apparatus. The computer readable medium can be a machine-readable storage device, a machine-readable storage substrate, a memory device, a composition of matter effecting a machine-readable propagated signal, or a combination of one or more of them. The terms "data processing apparatus", "computing device" and "computing processor" encompass all apparatus, devices, and machines for processing data, including by way of example a programmable processor, a computer, or multiple processors or computers. The apparatus can include, in addition to hardware, code that creates an execution environment for the computer program in question, e.g., code that constitutes processor firmware, a protocol stack, a database management system, an operating system, or a combination of one or more of them. A propagated signal is an artificially generated signal, e.g., a machine-generated electrical, optical, or electromagnetic signal, that is generated to encode information for transmission to suitable receiver apparatus.

A computer program (also known as an application, program, software, software application, script, or code) can be written in any form of programming language, including compiled or interpreted languages, and it can be deployed in any form, including as a stand-alone program or as a module, component, subroutine, or other unit suitable for use in a computing environment. A computer program does not necessarily correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application specific integrated circuit).

Processors suitable for the execution of a computer program include, by way of example, both general and special purpose microprocessors, and any one or more processors of any kind of digital computer. Generally, a processor will receive instructions and data from a read only memory or a random access memory or both. The essential elements of a computer are a processor for performing instructions and one or more memory devices for storing instructions and data. Generally, a computer will also include, or be operatively coupled to receive data from or transfer data to, or both, one or more mass storage devices for storing data, e.g., magnetic, magneto optical disks, or optical disks. However, a computer need not have such devices. Computer readable media suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto optical disks; and CD ROM and DVD-ROM disks. The processor and the memory can be supplemented by, or incorporated in, special purpose logic circuitry.

To provide for interaction with a user, one or more aspects of the disclosure can be implemented on a computer having a display device, e.g., a CRT (cathode ray tube), LCD (liquid crystal display) monitor, or touch screen for displaying information to the user and optionally a keyboard and a pointing device, e.g., a mouse or a trackball, by which the user can provide input to the computer. Other kinds of devices can be used to provide interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending web pages to a web browser on a user's client device in response to requests received from the web browser.

One or more aspects of the disclosure can be implemented in a computing system that includes a backend component, e.g., as a data server, or that includes a middleware component, e.g., an application server, or that includes a frontend component, e.g., a client computer having a graphical user interface or a Web browser through which a user can interact with an implementation of the subject matter described in this specification, or any combination of one or more such backend, middleware, or frontend components. The components of the system can be interconnected by any form or medium of digital data communication, e.g., a communication network. Examples of communication networks include a local area network ("LAN") and a wide area network ("WAN"), an inter-network (e.g., the Internet), and peer-to-peer networks (e.g., ad hoc peer-to-peer networks).

While this specification contains many specifics, these should not be construed as limitations on the scope of the disclosure or of what may be claimed, but rather as descriptions of features specific to particular implementations of the disclosure. Certain features that are described in this specification in the context of separate implementations can also be implemented in combination in a single implementation. Conversely, various features that are described in the context of a single implementation can also be implemented in multiple implementations separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings in a particular order, this should not be understood as requiring that such operations be performed in the particular order shown or in sequential order, or that all illustrated operations be performed, to achieve desirable results. In certain circumstances, multi-tasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

A number of implementations have been described. Nevertheless, it will be understood that various modifications may be made without departing from the spirit and scope of the disclosure. Accordingly, other implementations are within the scope of the following claims. For example, the actions recited in the claims can be performed in a different order and still achieve desirable results.

What is claimed is:

1. A method of tandem time-of-flight mass spectrometry analysis, the method comprising:

pulsed extracting a plurality of parent ion species of different m/z values out of an ion source or a pulsed converter;

time separating the parent ions by m/z value within a multi-reflecting electrostatic field having isochronous and spatial focusing;

selecting a parent ion species by an electric pulsed field with a time gate delayed relative to a source pulse;

fragmenting admitted parent ions in collisions with at least one of a gas and a surface;

extracting fragment ions by a pulsed electric field at a delay relative to the time gate;

time separating the fragment ions within the multi-reflecting electrostatic field; and recording a signal waveform of the fragment ions by a detector, wherein the selecting of the parent ion species is performed multiple times per single source pulse, wherein source pulses are repeated multiple times within an signal acquisition cycle, wherein, at least one of gate times and extraction delays are encoded in a non-redundant manner that varies within a cycle of multiple source pulses and wherein separate fragment spectra for the plurality of parent ion species are decoded based on a signal correlation with a repetitive occurrence of particular gate times with account of occurred extraction delay and with post analysis of occurred signal overlaps.

2. The method of claim 1, wherein both time separations of parent and fragment ions occur within the same multi-reflecting electrostatic field either along different mean trajectories or in opposite directions.

3. The method of claim 1, further comprising reconstructing chromatographic separation, surface scanning, or ion mobility profiles from intensity distributions of fragment ions corresponding to a same parent ion.

4. The method of claim 1, wherein the gate times and/or delay times are encoded by a non-redundant matrix constructed from a set of mutually orthogonal matrix blocks.

5. The method of claim 1, wherein the extraction delays are chosen from a set of non-linearly progressing delays with minimal interval exceeding typical peak width in fragment spectra.

6. A method as set forth in claim 5, wherein the set of non-linearly progressing delays is formed with linearly progressing intervals proportional to $n*(n+1)/2$ with an integer index n.

7. The method of claim 1, wherein the number S of source pulses per the acquisition cycle is selected from the group consisting of: (i) from 10 to 30; (ii) from 30 to 100; (iii) from 100 to 300; (iv) from 300 to 1000; and (v) above 1000.

8. The method of claim 1, wherein the number W of parent selection gates per single source pulse is selected from the group consisting of: (i) from 10 to 30; (ii) from 30 to 100; (iii) from 100 to 300; (iv) from 300 to 1000; and (v) above 1000.

9. The method as set forth in claim 1, wherein the average interval between parent selection pulses is selected from the group consisting of: (i) from 10 to 100 ns; (ii) from 100 ns to 1 μs; (iii) from 1 to 10 μs; and (iv) above 10 μs.

10. A tandem time-of-flight mass spectrometer comprising:

a pulsed ion source or a pulsed converter that emits ion packets of plural parent species;

a fragmentation cell with a pulsed acceleration of fragment ions;

a multi-reflecting time-of-flight mass (MR-TOF) analyzer arranged to pass parent and fragment ions within the same the MR-TOF analyzer either along different trajectories or in opposite directions;

a pulse generator configured to pulse at least two pulse strings triggering both timed selection of parent ions and delayed pulsed extraction of fragment ions; and a data system configured to acquire non-mixed signals of fragment ions and to non-redundantly encode the triggering pulses within a cycle of multiple source pulses, the non-redundant encoding being arranged to avoid or minimize repetitive overlapping of any two ion signals from different parent species at multiple repetitions of any individual gate time.

11. The apparatus of claim 10, wherein the data system is arranged to acquire either one long signal waveform or a set of separate signal waveforms along with the information on the current start number.

12. The apparatus of claim 10, further comprising:

a parallel processor configured to decode separate fragment spectra for all admitted parent ions (i) based on a correlation between fragment signals and any particular gate time and (ii) with a reconstruction of occurred signal overlaps.

13. The apparatus of claim 10, wherein the pulsed source is one of an axial or radial trap with radiofrequency ion confinement and pulsed ejection, a pass-through radiofrequency ion guide with pulsed radial ion ejection, a pulsed accumulating electron impact ion source, and a MALDI ion source with a delayed extraction.

14. The apparatus of claim 10, further comprising:

a deflector or a curved sector interface arranged that couples the MR-TOF analyzer to at least one of the pulsed ion source, the fragmentation cell, and a detector of the data system.

15. The apparatus of claim 10, wherein the MR-TOF analyzer is a planar or a cylindrical analyzer having at least a third order time-per-energy focusing and at least second order full focusing including cross aberration terms.

16. The apparatus of claim 10, wherein the MR-TOF analyzer further comprises at least one of a set of periodic lenses within a field-free region and at least one spatially modulated electrode that spatial modulates an ion mirror field to confine ions along a zigzag trajectory in a drift direction.

17. The apparatus of claim 10, wherein the fragmentation cell is one of a surface induced dissociation (SID) with normally impinging parent ions and with a pulsed delayed extraction of fragment ions, a pass-through high energy collision induced dissociation (CID) cell, and an SID cell with gliding collisions followed by a pulsed delayed extraction.

18. A method of multiplexed mass-spectral analysis comprising the following steps:

sampling a subset of plural ion sources;

forming a distinct, sparse and repetitive spectral signal with limited signal overlapping between sampled spectra from different ion sources;

recording a mass spectrum with at least one detector;

repeating the steps of sampling, forming, and spectral recording while varying the source subsets in a non-redundant fashion where combinations of any two simultaneously sampled sources are unique and any particular source is sampled multiple times; and decoding signals from all individual sources by correlating encoded signal with sources sampled.

19. The method of claim 18, wherein the encoding step is adjusted automatically based on a sparseness of the acquired spectra.

20. The method of claim 18, wherein the step of forming includes constructing a non-redundant matrix based on a set of mutually orthogonal square matrix blocks.

21. The method of claim 18, further comprising a step of delaying the ion sources with non-linearly progressing delays being encoded based on a non-redundant matrix.

22. The method of claim 18 wherein the plurality of ion sources is one of a subset of multiple ion flows multiplexed downstream of a single ion source and a subset of multiple ion packets generated in the single ion source or multiple pulsed ion sources or pulsed converters.

* * * * *